US011187432B2

(12) United States Patent
Morimoto et al.

(10) Patent No.: US 11,187,432 B2
(45) Date of Patent: Nov. 30, 2021

(54) HEAT EXCHANGER AND CORRUGATED FIN

(71) Applicant: DENSO CORPORATION, Kariya (JP)

(72) Inventors: Keita Morimoto, Kariya (JP); Tomohiko Nakamura, Kariya (JP); Tatsuhiko Nishino, Kariya (JP); Toshiya Nagasawa, Kariya (JP); Masahiro Shimoya, Kariya (JP); Mitsuyoshi Saito, Kariya (JP); Shota Chatani, Kariya (JP)

(73) Assignee: DENSO CORPORATION, Kariya (JP)

( * ) Notice: Subject to any disclaimer, the term of this patent is extended or adjusted under 35 U.S.C. 154(b) by 41 days.

(21) Appl. No.: 16/696,855

(22) Filed: Nov. 26, 2019

(65) Prior Publication Data

US 2020/0096226 A1 Mar. 26, 2020

Related U.S. Application Data

(63) Continuation of application No. PCT/JP2018/021847, filed on Jun. 7, 2018.

(30) Foreign Application Priority Data

Jun. 12, 2017 (JP) ..... JP2017-115289
May 31, 2018 (JP) ..... JP2018-105208

(51) Int. Cl.
*F28F 1/10* (2006.01)
*F24F 13/22* (2006.01)
(Continued)

(52) U.S. Cl.
CPC ..... *F24F 13/22* (2013.01); *F25B 39/02* (2013.01); *F28F 1/30* (2013.01); *F28F 1/32* (2013.01)

(58) Field of Classification Search
CPC ..... F24F 13/22; F24F 1/30; F24F 1/32; F25B 39/02
(Continued)

(56) References Cited

U.S. PATENT DOCUMENTS 5,992,514 A * 11/1999 Sugimoto ..... F28D 1/0435 165/135
2002/0017381 A1* 2/2002 Ozaki ..... F28D 1/0435 165/135
(Continued)

FOREIGN PATENT DOCUMENTS

JP S60194293 A 10/1985
JP S61165371 U 10/1986
(Continued)

OTHER PUBLICATIONS

U.S. Appl. No. 16/696,767, filed Nov. 26, 2019, Morimoto et al.

*Primary Examiner* — Davis D Hwu
(74) *Attorney, Agent, or Firm* — Harness, Dickey & Pierce, P.L.C.

(57) ABSTRACT

A heat exchanger includes a tube, a corrugated fin, and a plurality of grooves. The corrugated fin has a plurality of bent portions and a plurality of fin main bodies disposed between the bent portions. The multiple grooves are arranged at specified intervals from each other and are formed on a surface of the corrugated fin to enhance the hydrophilicity of the surface. The corrugated fin includes a first thick portion in which at least one of the grooves is included and a second thick portion thicker than the first thick portion in a cross-sectional view along an extending direction of the bent portions.

7 Claims, 32 Drawing Sheets

(51) Int. Cl.

| | |
|---|---|
| ***F25B 39/02*** | (2006.01) |
| ***F28F 1/30*** | (2006.01) |
| ***F28F 1/32*** | (2006.01) |

(58) Field of Classification Search
USPC ..... 165/172
See application file for complete search history.

(56) References Cited

U.S. PATENT DOCUMENTS

| | | | |
|---|---|---|---|
| 2004/0050538 | A1 | 3/2004 | Sunder et al. |
| 2007/0199686 | A1 | 8/2007 | Okinotani et al. |
| 2014/0338876 | A1 | 11/2014 | Hokazono |
| 2018/0058780 | A1 | 3/2018 | Nishiyama et al. |

FOREIGN PATENT DOCUMENTS

| | | | |
|---|---|---|---|
| JP | 2004060934 | A | 2/2004 |
| JP | 2004108769 | A | 4/2004 |
| JP | 2007232246 | A | 9/2007 |
| JP | 2009150621 | A | 7/2009 |
| JP | 2013245883 | A | 12/2013 |
| JP | 2014098499 | A | 5/2014 |
| JP | 5661202 | B2 | 1/2015 |
| JP | 2019002587 | A | 1/2019 |
| WO | WO-2016/181509 | A1 | 11/2016 |

* cited by examiner

HEAT EXCHANGER AND CORRUGATED FIN

CROSS REFERENCE TO RELATED APPLICATIONS

This application is a continuation application of international Patent Application No. PCT/JP2018/021847 filed on Jun. 7, 2018, which designated the U.S. and claims the benefit of priority from Japanese Patent Application No. 2017-115289 filed on Jun. 12, 2017 and Japanese Patent Application No. 2018-105208 filed on May 31, 2018. The entire disclosure of all of the above applications are incorporated herein by reference.

TECHNICAL FIELD

The present disclosure relates to a heat exchanger and a corrugated fin.

BACKGROUND ART

A heat exchanger for exchanging a heat between fluids has been known. When the heat exchanger is used as an evaporator, if a condensed water stays on surface of fins provided the outside of a tube through which a refrigerant flows, there is a problem that a ventilation resistance increases due to clogging of the condensed water in gaps between the fins, and a heat exchanging performance by the heat exchanger is deteriorated.

SUMMARY OF THE INVENTION

One aspect of the present disclosure is a heat exchanger for exchanging a heat between fluids. The heat exchanger includes:

a tube through which a first fluid flows;

a corrugated fin that includes a plurality of bent portions and a plurality of fin main bodies, the plurality of bent portions formed by bending a plate member at specified intervals, each of the plurality of fin main bodies disposed between two of the plurality of bent portions, the corrugated fin configured to enhance a heat exchange efficiency between the first fluid flowing through the tube and a second fluid flowing outside the tube; and a plurality of grooves that are disposed on a surface of the corrugated fin to enhance a hydrophilicity of the surface of the corrugated fin, the plurality of grooves arranged to be spaced away from each other at specified intervals, wherein the corrugated fin has a cross-section in a view parallel to an extending direction of each of the plurality of bent portions, the cross-section including a plurality of first thick portions and a plurality of second thick portions that are thicker than the plurality of first thick portions, each of the plurality of first thick portions including at least one of the plurality of grooves.

DESCRIPTION OF EMBODIMENTS

Figure 1:
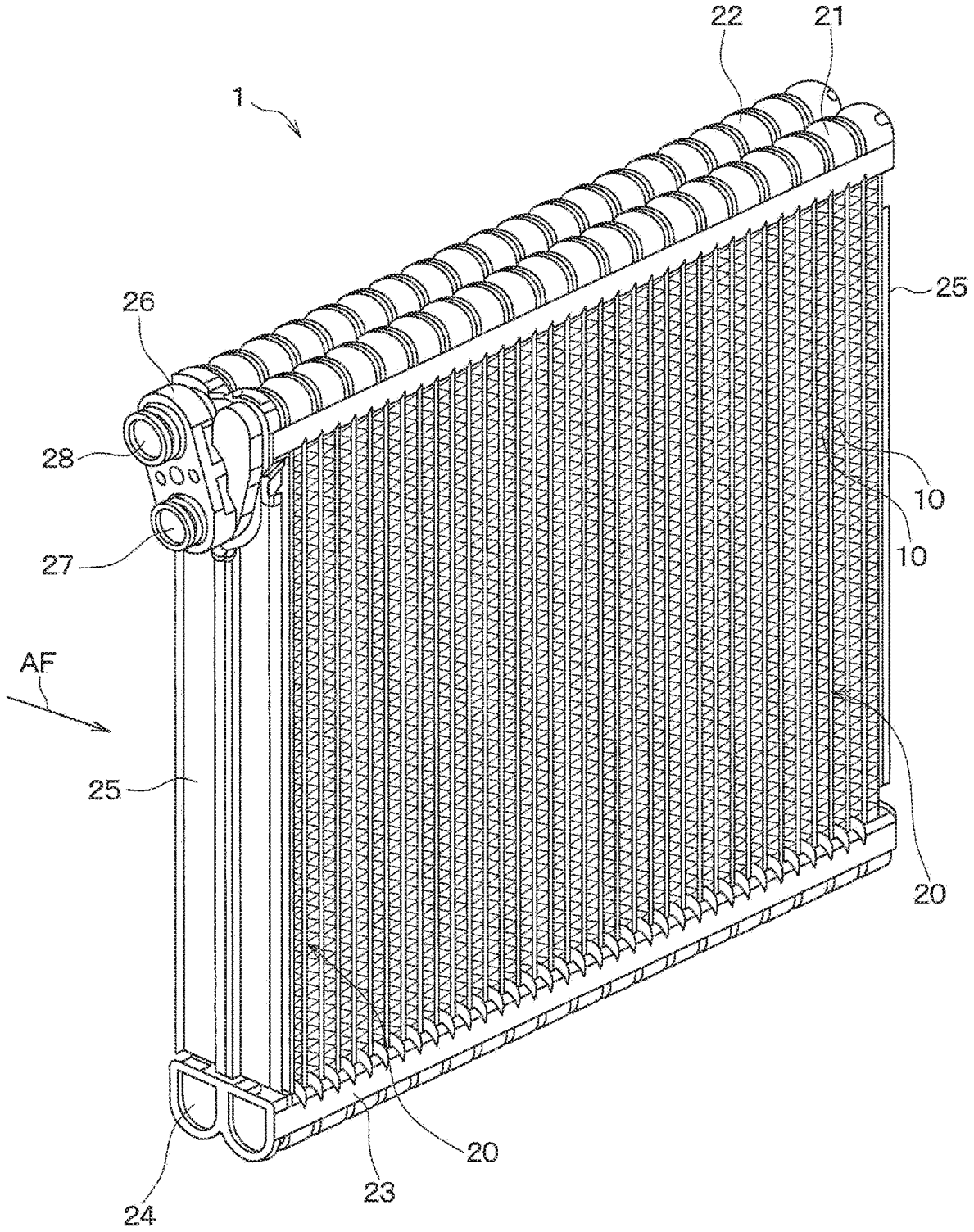
FIG. 1 is a perspective view of a heat exchanger according to a first embodiment.

In heat exchangers, unevenness is formed on the surface of the fins by oxidizing the fins by a heat generated when the plate fins and the tube are welded, hydrophilicity of the surface is increased, and drainability is improved. As a result, the heat exchanger prevents the condensed water from staying on the surface of the plate fins and prevents an increase in the ventilation resistance of the gaps between the fins.

Such a heat exchanger uses plate fins. However, when a high heat exchanging performance is required for the heat exchanger, it is desirable to use corrugated fins higher in heat exchanging performance than the plate fins.

However, in the heat exchanger described above, since the surface of the fins is oxidized to form unevenness, if the unevenness is locally formed in a concentrated manner, the rigidity of the fins may be lowered. When the corrugated fin is formed by bending a plate member having the above unevenness at predetermined intervals, the corrugated fins may buckle during a bending process or during a process of equalizing a height of the crests of the fins, thereby deteriorating the formability.

It is an objective of the present disclosure to provide a heat exchanger and a corrugated fin capable of improving the drainability of the corrugated fin and improving the formability of the corrugated fin.

One aspect of the present disclosure is a heat exchanger for exchanging a heat between fluids. The heat exchanger includes:

a tube through which a first fluid flows;

a corrugated fin that includes a plurality of bent portions and a plurality of fin main bodies, the plurality of bent portions formed by bending a plate member at specified intervals, each of the plurality of fin main bodies disposed between two of the plurality of bent portions, the corrugated fin configured to enhance a heat exchange efficiency between the first fluid flowing through the tube and a second fluid flowing outside the tube; and a plurality of grooves that are disposed on a surface of the corrugated fin to enhance a hydrophilicity of the surface of the corrugated fin, the plurality of grooves arranged to be spaced away from each other at specified intervals, wherein the corrugated fin has a cross-section in a view parallel to an extending direction of each of the plurality of bent portions, the cross-section including a plurality of first thick portions and a plurality of second thick portions that are thicker than the plurality of first thick portions, each of the plurality of first thick portions including at least one of the plurality of grooves.

According to the above configuration, the multiple grooves are aligned on the surface of the corrugated fin at predetermined intervals, to thereby enhance the hydrophilicity of the surface of the corrugated fins and improve the drainability. For that reason, the condensed water is prevented from staying on the surface of the corrugated fins. Therefore, the heat exchanger can prevent an increase in the ventilation resistance of the gaps between the corrugated fins and enhance the heat exchanging performance.

Further, in the corrugated fin, the second thick portion greater in a plate thickness than the first thick portion is intermittently disposed in the extending direction of the bent portions, whereby the rigidity in the extending direction of the bent portions is increased. For that reason, for example, when the bent portion is formed by bending the plate member at the time of forming the corrugated fin, the corrugated fin is prevented from buckling at the bent portion. In addition, the corrugated fin is prevented from buckling in the fin main body when a compressing force is applied to the bent portion in a vertical direction, for example, during forming of the corrugated fin or during manufacturing of the heat exchanger.

The second thick portion greater in plate thickness than the first thick portion includes not only a portion in which a groove is not provided in the plate member but also a portion in which a groove or a recess portion (for example, a depth of several μm) which is shallow enough not to contribute to an improvement in hydrophilicity of the fin surface is provided.

Another aspect of the present disclosure is a heat exchanger for exchanging a heat between fluids. The heat exchanger includes:

a tube through which a first fluid flows;

a corrugated fin that includes a plurality of bent portions and a plurality of fin main bodies, the plurality of bent portions formed by bending a plate member at specified intervals, each of the plurality of fin main bodies disposed between two of the plurality of bent portions, the corrugated fin configured to enhance a heat exchange efficiency between the first fluid flowing through the tube and a second fluid flowing outside the tube; and a plurality of grooves that are disposed on a surface of the corrugated fin to enhance a hydrophilicity of the surface of the corrugated fin, the plurality of grooves arranged to be spaced away from each other at specified intervals and extending to be angled relative to an extending direction of each of the plurality of bent portions.

According to the above configuration, the configuration of another aspect can exhibit the same operation and effects as the operation and effects described in one aspect described above. In the configuration of the other aspect, for example, when the plate member is bent to form the bent portion, or when a compressing force is applied to the formed bent portion in a vertical direction, a stress generated in the corrugated fin is substantially uniform in a direction orthogonal to a direction in which the bent portions extend. This makes it possible to more reliably prevent the corrugated fin from buckling at the bent portion and the fin main body at the time of forming the corrugated fin.

Yet another aspect of the present disclosure is a corrugated fin formed by bending a plate member at specified intervals. The corrugated fin includes:

a plurality of bent portions at which the plate member is bent;

a plurality of fin main bodies, each of the plurality of fin main bodies disposed between two of the plurality of bent portions; and a plurality of grooves that are disposed on a surface of the corrugated fin to enhance a hydrophilicity of the surface of the corrugated fin, the plurality of grooves arranged at specified intervals, wherein the plurality of bent portions and the plurality of fin main bodies have cross-sections in a view parallel to an extending direction of each of the plurality of bent portions, the cross-sections including a plurality of first thick portions and a plurality of second thick portions that are thicker than the plurality of first thick portions, each of the first thick portions including at least one of the plurality of grooves.

According to the above configuration, the hydrophilicity of the surface of the corrugated fin is increased by the multiple grooves, and the drainability is improved. Therefore, the corrugated fin can prevent condensed water from staying on the surface of the corrugated fin.

Further, in the corrugated fin, the second thick portion greater in a plate thickness than the first thick portion is intermittently disposed in the extending direction of the bent portions, whereby the rigidity in the extending direction of the bent portions is increased. For that reason, the corrugated fin can be prevented from buckling at the bent portion, for example, when the plate member is bent to form the bent portion at the time of forming the corrugated fin. In addition, the corrugated fin can be prevented from buckling at the fin main body when a compressing force is applied to the bent portion in the vertical direction, for example, at the time of forming the corrugated fin or at the time of manufacturing the heat exchanger.

In view of the above, embodiments of the present disclosure will be described below with reference to the drawings. In the following embodiments, the same or equivalent parts are denoted by the same reference numerals, and their descriptions will be omitted. In the drawings, hatching indicating a cross section of a corrugated fin is omitted in order to avoid confusion between lines indicating a groove provided in the corrugated fin and the hatching indicating the cross section of the corrugated fin.

First Embodiment

A first embodiment will be described with reference to the drawings. A heat exchanger 1 according to the present embodiment is used, for example, as an evaporator configuring a part of a refrigeration cycle for performing air conditioning in a vehicle compartment. The evaporator performs a heat exchange between a refrigerant as a first fluid circulating in the refrigeration cycle and an air as a second fluid passing through the heat exchanger 1, and cools the air by a latent heat of evaporation of the refrigerant. In FIG. 1, a flow direction of the air passing through the heat exchanger 1 is indicated by an arrow AF.

Figure 2:
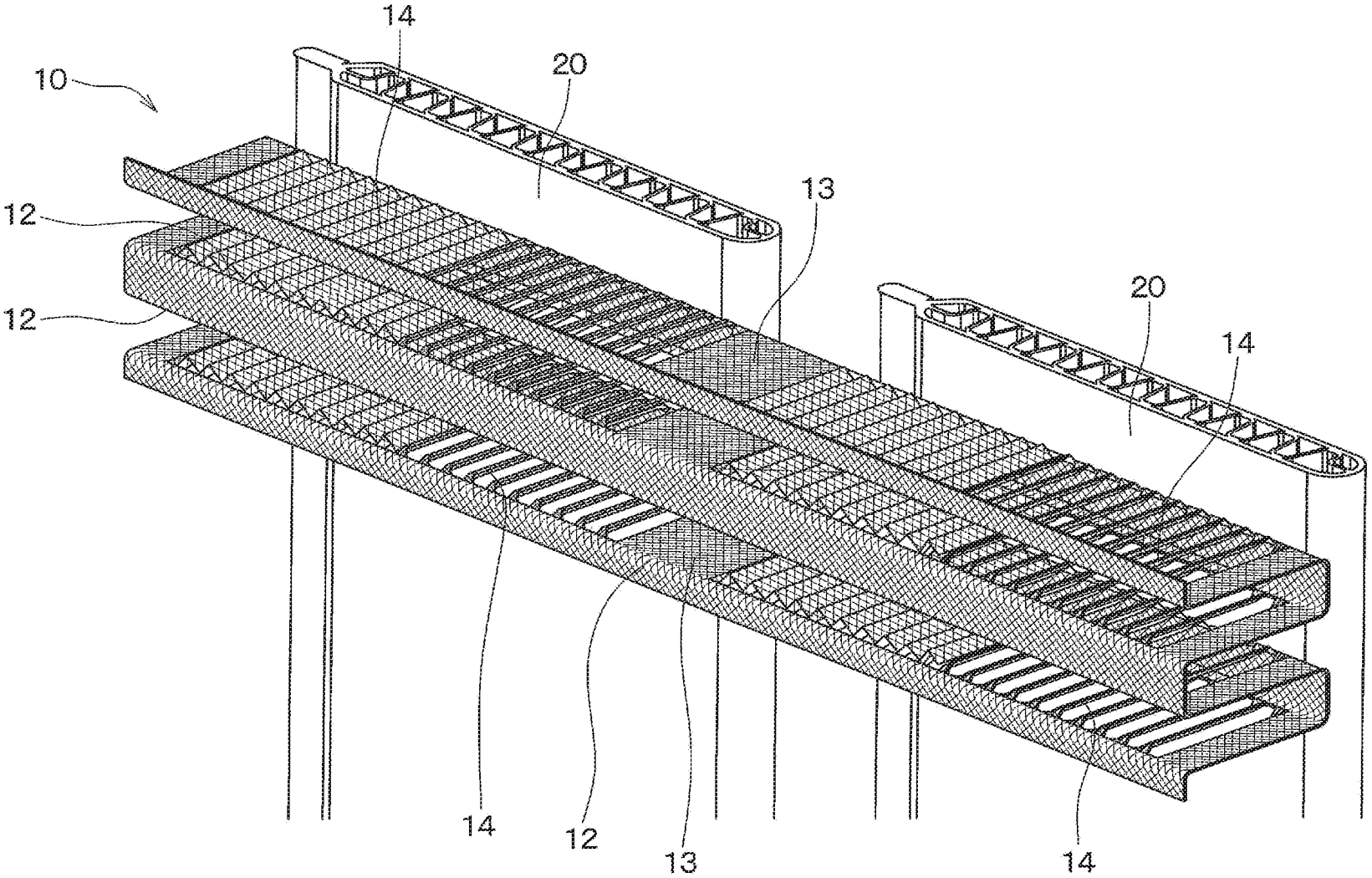
FIG. 2 is a partially enlarged view of the heat exchanger.

As shown in FIGS. 1 and 2, the heat exchanger 1 includes corrugated fins 10, tubes 20, first to fourth header tanks 21 to 24, outer frame members 25, a pipe connection member 26, and the like. Those members are made of aluminum, for example, and the members are joined to each other by brazing.

The multiple tubes 20 are arrayed at predetermined intervals in a direction intersecting with an air flow direction. The multiple tubes 20 are arrayed in two rows on an upstream side and a downstream side in the air flow direction. Each of the multiple tubes 20 extends linearly from one end to the other end. One end of the multiple tubes 20 is inserted into the first header tank 21 or the second header tank 22, and the other end is inserted into the third header tank 23 or the fourth header tank 24. The first to fourth header tanks 21 to 24 distribute the refrigerant to the multiple tubes 20 and collect the refrigerant flowing in from the multiple tubes 20.

An air passage through which an air flows is provided in each of multiple gaps provided between the multiple tubes 20. The corrugated fins 10 are provided in the air passages. In other words, the corrugated fins 10 according to the present embodiment are outer fins provided on the outside of the tubes 20. The corrugated fins 10 increase a heat transfer area between the refrigerant flowing inside the tubes 20 and the air flowing outside the tubes 20, to thereby enhance a heat exchange efficiency between the refrigerant and the air.

The outer frame members 25 are provided outside a direction in which the multiple tubes 20 and the multiple corrugated fins 10 are alternately aligned. A pipe connection member 26 is fixed to the outer frame member 25. The pipe connection member 26 is provided with a refrigerant inlet 27 to which the refrigerant is supplied and a refrigerant outlet 28 for discharging the refrigerant. The refrigerant flowing into the first header tank 21 from the refrigerant inlet 27 flows through the first to fourth header tanks 21 to 24 and the multiple tubes 20 in a predetermined path, and flows out from the refrigerant outlet 28. At that time, a latent heat of evaporation of the refrigerant flowing through the first to fourth header tanks 21 to 24 and the multiple tubes 20 cools the air flowing through the air passage provided with the corrugated fins 10.

Figure 3:
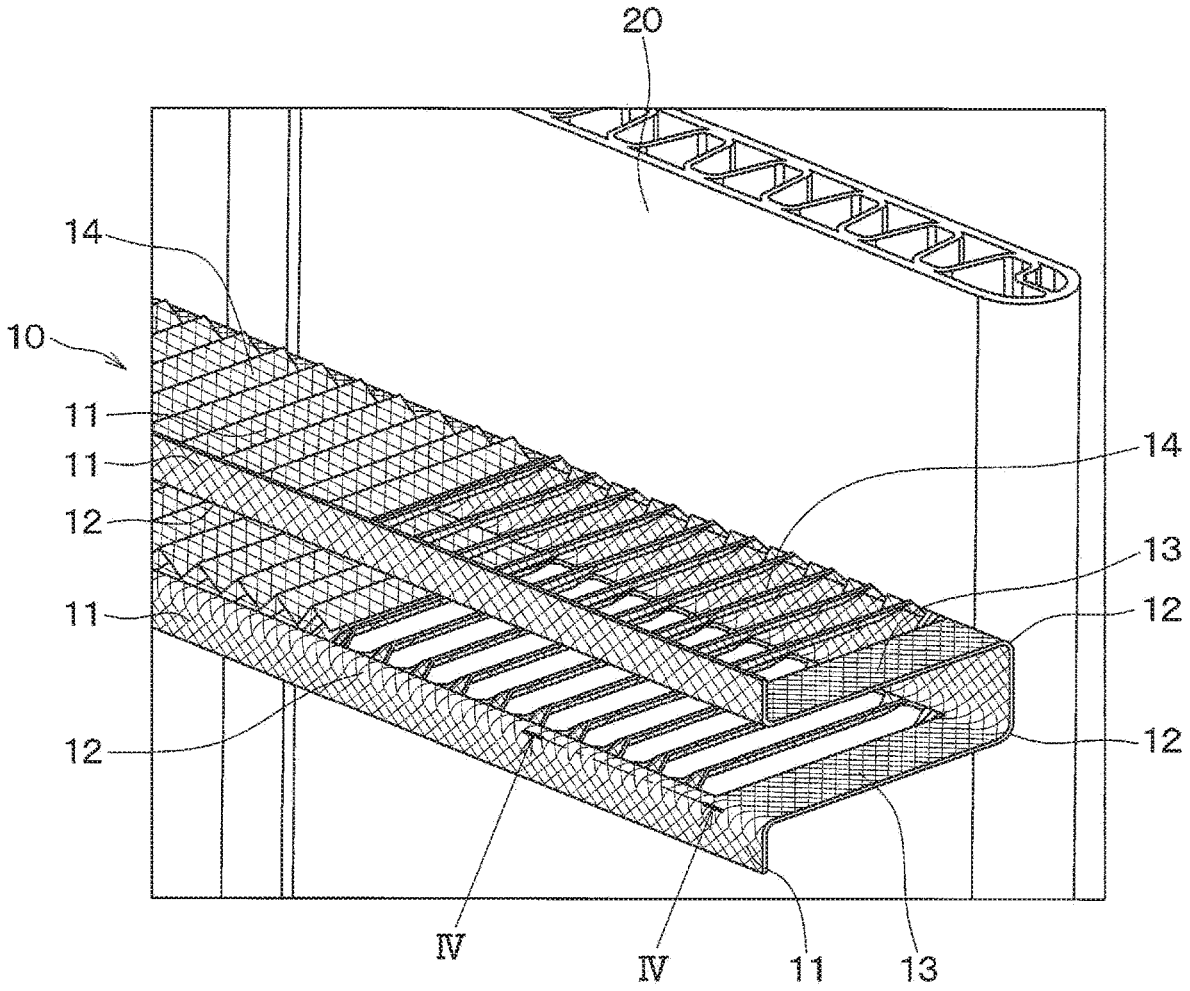
FIG. 3 is a partially enlarged view of FIG. 2.

FIGS. 2 and 3 show enlarged views of the corrugated fin 10. The corrugated fin 10 has a configuration in which a plate member 100 is bent at predetermined intervals. The corrugated fin 10 has multiple bent portions 12 and fin main bodies 13. The multiple bent portions 12 are portions in which the plate member 100 configuring the corrugated fins 10 is bent at predetermined intervals. The fin main bodies 13 are portions disposed between the bent portion 12 and the bent portion 12. The fin main body 13 is provided with multiple louvers 14 in which parts of the plate member 100 are cut and protruded. An outer wall of the corrugated fin 10 on the tube 20 side is joined to an outer wall of the tube 20 by brazing. If the louver 14 is expressed as a generic concept, the louver 14 is regarded as a cut protrusion in which a part of the fin main body 13 is cut and protruded in order to promote a heat transfer between the air contacting the corrugated fin 10 and the corrugated fin 10.

Multiple fine grooves 11 are provided on a surface of the corrugated fin 10. The multiple grooves 11 are aligned at a predetermined interval. In the drawings referred to in the present embodiment, the multiple grooves 11 provided on the surface of the corrugated fin 10 are schematically largely illustrated for the sake of description. This also applies to the reference examples to be described later and the drawings referred to in second to sixth embodiments.

The multiple grooves 11 are provided in the bent portion 12 and the fin main body 13 of the corrugated fin 10. The multiple grooves 11 are also provided in the louvers 14. In the present embodiment, the multiple grooves 11 extend obliquely with respect to the direction in which the bent portion 12 extends.

Figure 4:
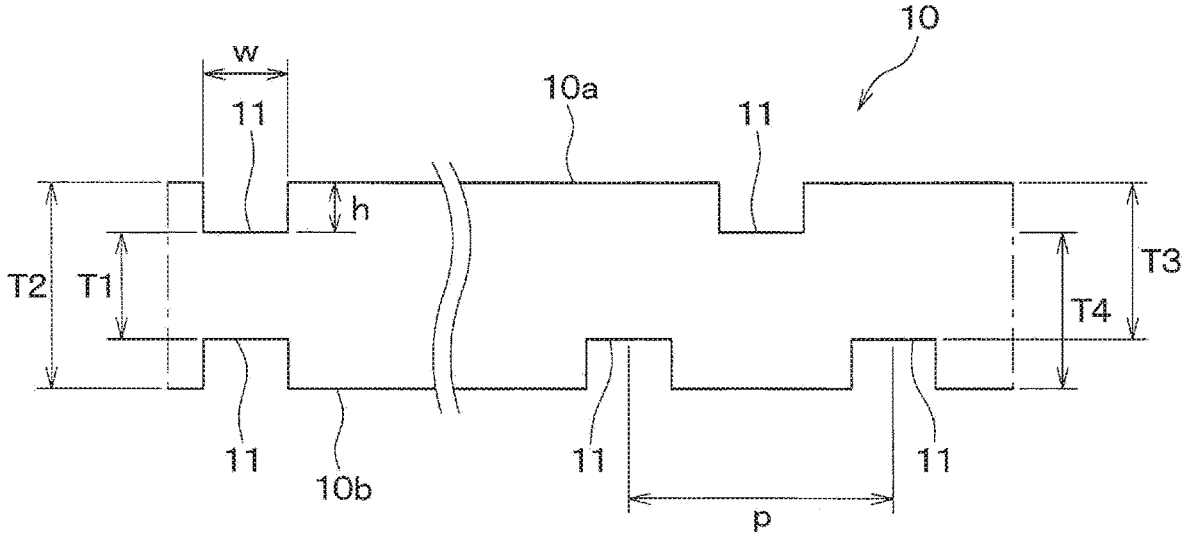
FIG. 4 is an enlarged view of a cross section taken along a line IV-IV of FIG. 3.

FIG. 4 is an enlarged view of a cross section taken along a line IV-IV of FIG. 3. As shown in FIG. 4, the corrugated fin 10 includes, in a cross-sectional view parallel to the direction in which the bent portion 12 extends, a first thick portion T1 in which the grooves 11 are provided and a second thick portion T2 which is thicker than the first thick portion T1. The second thick portion T2, which is thicker than the first thick portion T1, includes not only a portion in which the groove 11 is not provided in the plate member 100 but also a portion in which a groove or a recess portion (for example, a depth of several μm) which is shallow enough not to contribute to an improvement in hydrophilicity of the fin surface is provided. As a result, in the corrugated fin 10, the second thick portion T2 is intermittently disposed in the direction in which the bent portion 12 extends, to thereby increase the rigidity of the fin in the direction in which the bent portion 12 extends. The corrugated fin 10 may include a plate thick portion other than that shown in the drawing in addition to the first thick portion T1 and the second thick portion T2. The shape of the groove 11 is not limited to that shown in the drawings, and can be arbitrarily set. Plate thick portions T3 and T4 in which the groove 11 is provided on one surface or the other surface of the corrugated fin 10 in the thickness direction can also be referred to as the first thick portion in which the groove 11 is provided in the corrugated fin 10.

FIG. 4 shows an example of the width, depth, and pitch of the grooves 11. A width w of the groove 11 is preferably 10 to 50 μm. A depth h of the groove 11 is preferably 10 μm or more. A pitch p of the groove 11 is preferably 50 to 200 μm. This makes it possible to increase the hydrophilicity of the surface of the corrugated fin 10. When the hydrophilicity of the surface of the corrugated fin 10 is increased, the drainability of the corrugated fin 10 is improved, and the condensed water is prevented from staying on the surface of the corrugated fin 10. Therefore, since the ventilation resistance of the air passage can be prevented from increasing due to the stagnation of the condensed water, the heat exchanger 1 can improve the heat exchanging performance.

Figure 5:
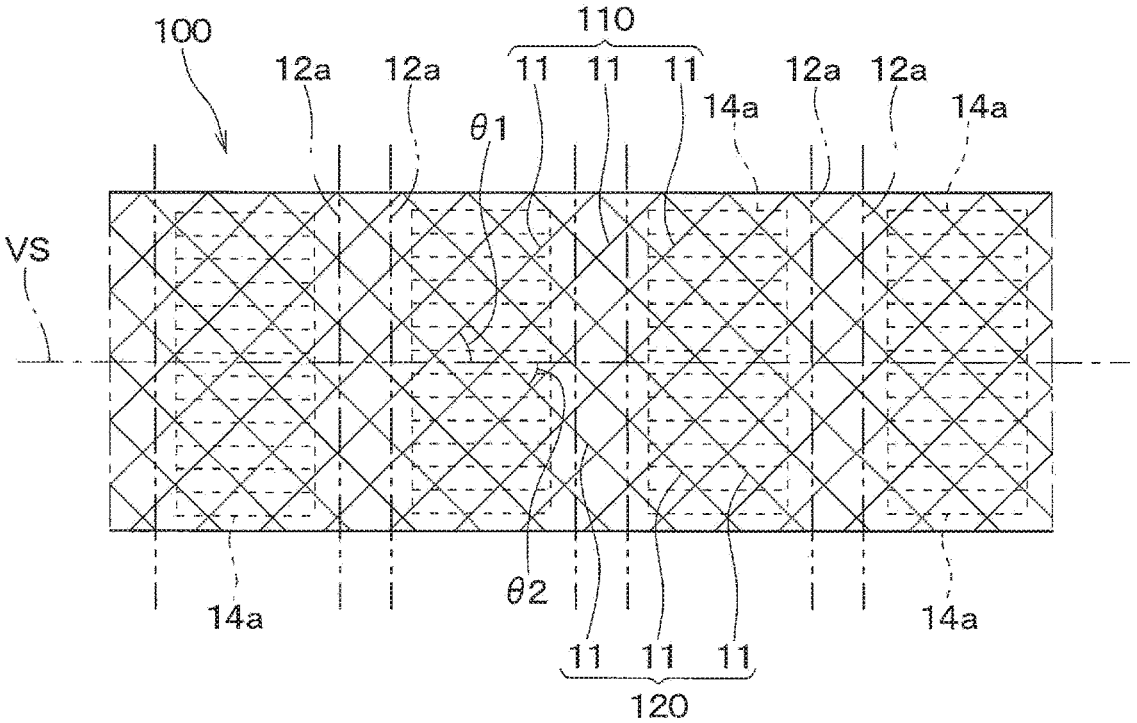
FIG. 5 is a plan view of a plate member configuring the corrugated fin according to the first embodiment.

FIG. 5 is a plan view of the plate member 100 configuring the corrugated fin 10. The corrugated fin 10 is formed in a corrugated plate-shape by being bent at positions indicated by two-dot chain lines 12*a* in FIG. 5. In FIG. 5, positions where the louvers 14 are provided on the plate member 100 are indicated by dashed lines 14*a*. In FIG. 5, an imaginary plane VS including the center of the bent portions 12 (that is, the center of the plate member 100 in the width direction) and perpendicular to the direction in which the bent portion 12 extends is indicated by a one-dot chain line VS. The multiple grooves 11 are provided symmetrically with respect to the imaginary plane VS. The same applies to FIG. 22 to FIG. 24, FIG. 26 to FIG. 29, FIG. 31, and FIG. 32, which are referred to in the description of the second to sixth embodiments to be described later.

Further, in FIG. 5, an angle formed by the direction in which the multiple grooves 11 extend and the imaginary plane VS is indicated by 61. As described above, the multiple grooves 11 extend obliquely with respect to the direction in which the bent portions 12 extend. In this case, in the present embodiment, it is preferable that the angle 61 formed by the direction in which the multiple grooves 11 extend and the imaginary plane VS falls in a range of $20° \leq \theta 1 \leq 70°$.

Further, the corrugated fin 10 according to the present embodiment is provided with a first groove group 110 formed of the multiple grooves 11, and a second groove group 120 formed of the multiple grooves 11 extending in a direction intersecting with the first groove group 110. As described above, the first groove group 110 is configured by the multiple grooves 11 provided so that an angle formed by the direction in which the multiple grooves 11 extend and the imaginary plane VS is θ1. On the other hand, the second groove group 120 is configured by the multiple grooves 11 provided so that an angle formed by the direction in which the multiple grooves 11 extend and the imaginary plane VS is θ2. In the present embodiment, θ1 is +45°, and θ2 is −45°. In other words, θ1 and θ2 are different angles.

The multiple grooves 11 configuring the first groove group 110 are provided so that the grooves 11 are aligned at predetermined intervals. The multiple grooves 11 configuring the second groove group 120 are also provided so that the grooves 11 are aligned at predetermined intervals. Further, the grooves 11 configuring the first groove group 110 and the grooves 11 configuring the second groove group 120 are provided so as to be connected from the fin main body 13 to the bent portion 12.

As shown in FIG. 4, the multiple grooves 11 are provided on one surface 10*a* of the corrugated fin 10 in the thickness direction and on the other surface 10*b* of the corrugated fin 10 in the thickness direction. In the following description, one surface 10*a* of the corrugated fin 10 in the thickness direction is referred to as a first surface 10*a*, and the other surface 10*b* of the corrugated fin 10 in the thickness direction is referred to as a second surface 10*b*. In the present embodiment, the first groove group 110 and the second groove group 120 are provided on the first surface 10*a*, and the first groove group 110 and the second groove group 120 are also provided on the second surface 10*b*.

Figure 10:
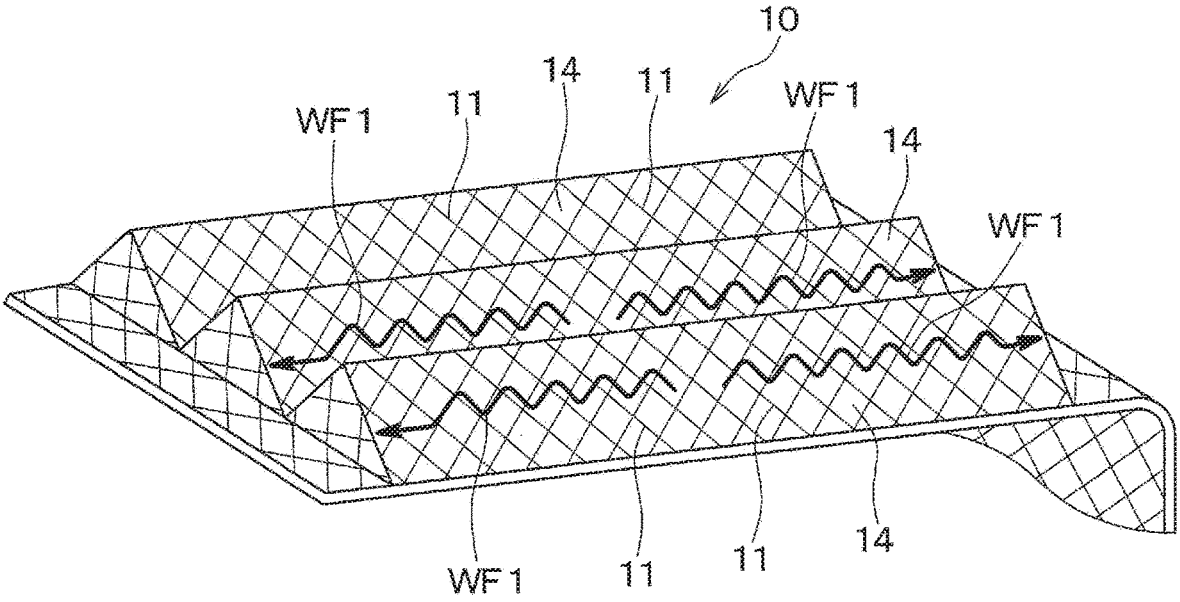
FIG. 10 is an illustrative view illustrating a flow of a condensed water.
Figure 11:
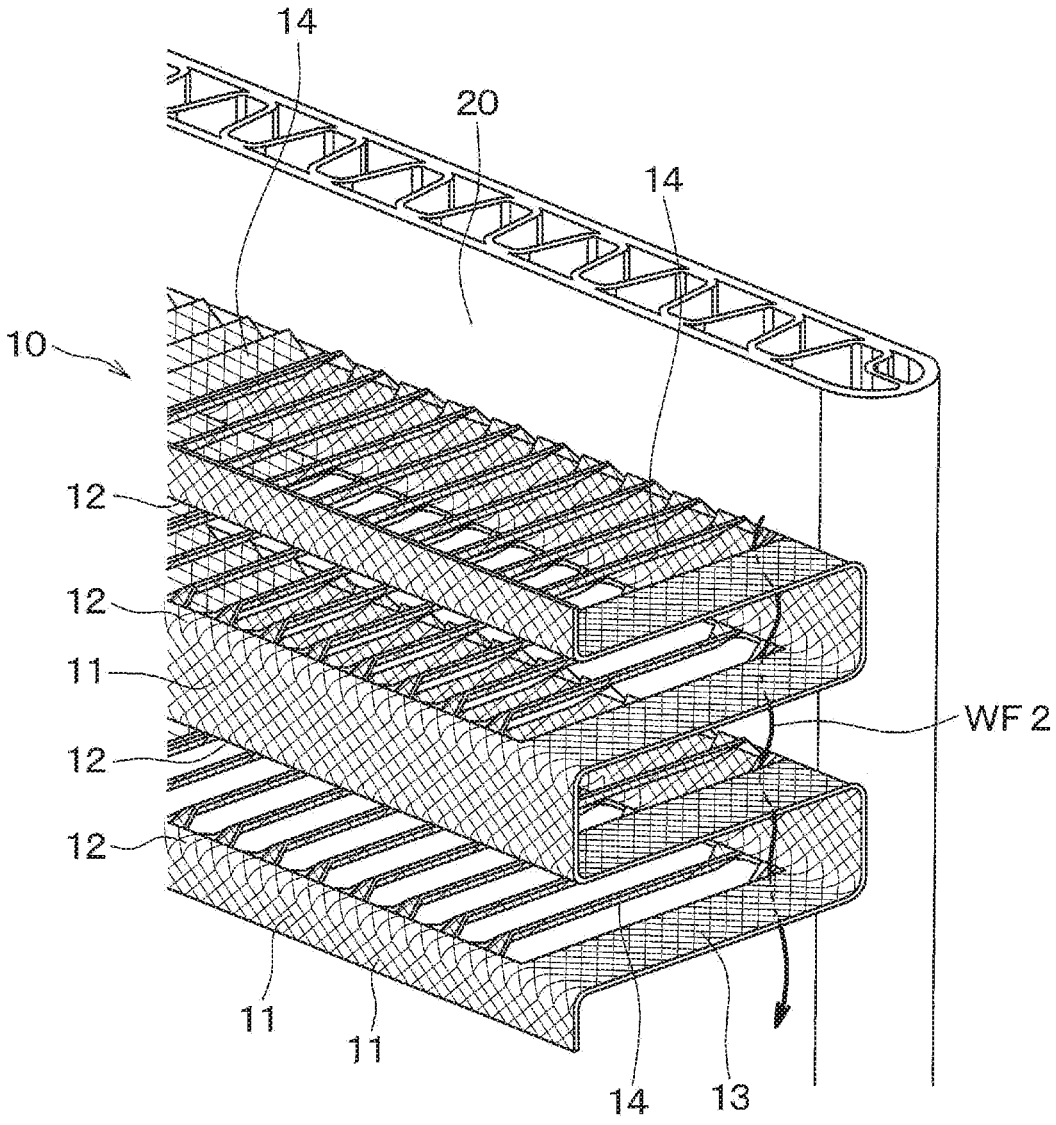
FIG. 11 is an illustrative view illustrating the flow of the condensed water.

FIGS. 10 and 11 are illustrative diagrams illustrating a flow of condensed water in the heat exchanger 1. When the heat exchanger 1 is used as an evaporator, a heat exchange between the air and the refrigerant is performed most efficiently in the louvers 14 of the corrugated fin 10. For that reason, a large amount of condensed water in which moisture contained in the air is condensed is generated on the surface of the louver 14. As indicated by arrows WF1 in FIG. 10, the condensed water flows to the bent portions 12 through the grooves 11 configuring the first groove group 110 and the grooves 11 configuring the second groove group 120. Then, as indicated by an arrow WF2 in FIG. 11, the condensed water flows down through the holes in the louvers 14 formed in the fin main body 13, the walls of the tubes 20, and the like. Therefore, the heat exchanger 1 can prevent the condensed water from staying in the louvers 14 of the corrugated fins 10.

Figure 6:
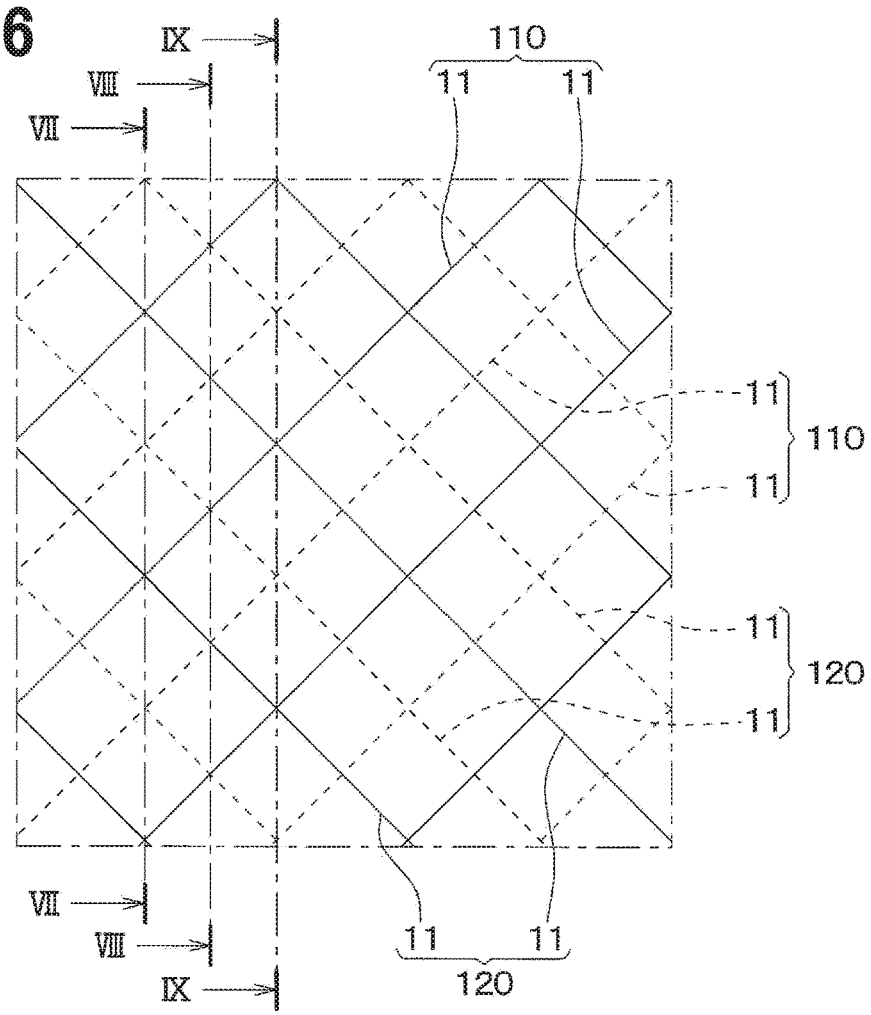
FIG. 6 is a partially enlarged view of FIG. 5.

In FIG. 6, the first groove group 110 and the second groove group 120 provided in the first surface 10*a* of the corrugated fin 10 are indicated by solid lines, and the first groove group 110 and the second groove group 120 provided in the second surface 10*b* are indicated by dashed lines. The first groove group 110 and the second groove group 120 provided in the first surface 10*a* and the first groove group 110 and the second groove group 120 provided in the second surface 10*b* are provided at positions offset from each other.

Figure 7:
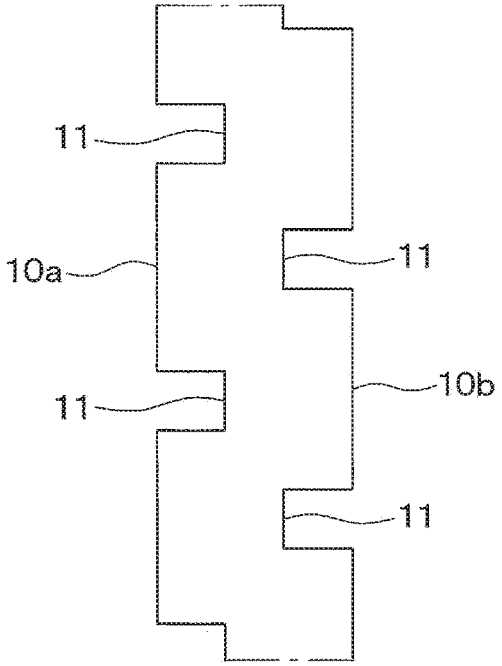
FIG. 7 is a cross-sectional view taken along a line VII-VII of FIG. 6.
Figure 8:
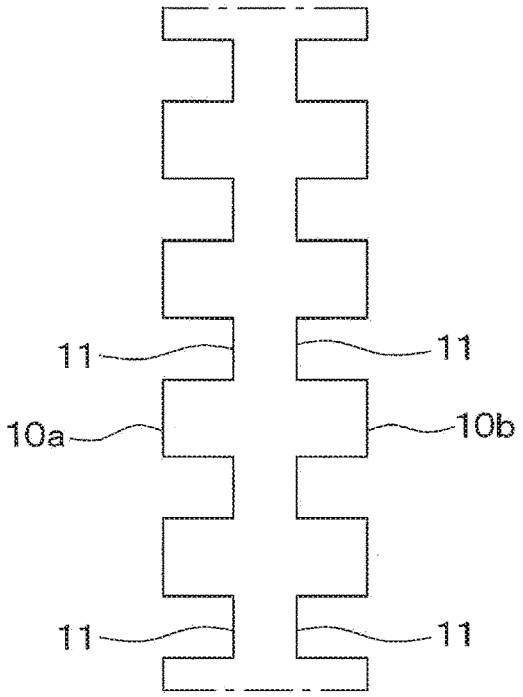
FIG. 8 is a cross-sectional view taken along a line VIII-VIII of FIG. 6.
Figure 9:
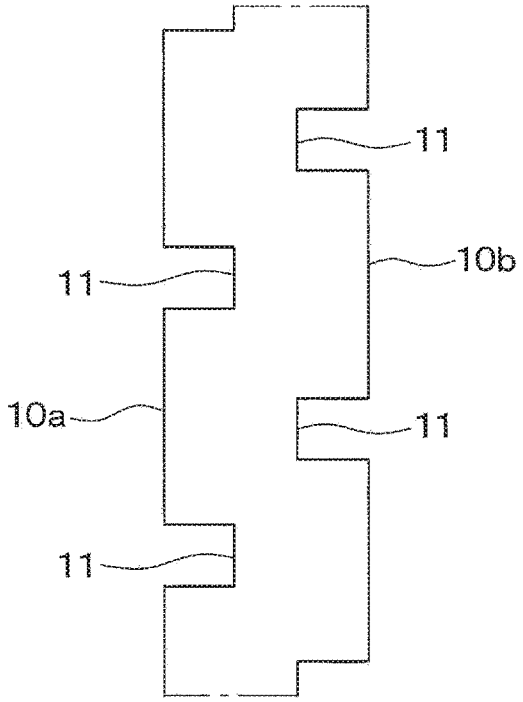
FIG. 9 is a cross-sectional view taken along a line IX-IX of FIG. 6.

A cross section taken along a line VII-VII of FIG. 6 is shown in FIG. 7, a cross section taken along a line VIII-VIII line of FIG. 6 is shown in FIG. 8, and a cross section taken along a line IX-IX of FIG. 6 is shown in FIG. 9. In FIGS. 7 and 9, the grooves 11 provided on the first surface 10*a* and the grooves 11 provided on the second surface 10*b* are located at positions offset from each other. In FIG. 8, the grooves 11 provided on the first surface 10*a* and the grooves 11 provided on the second surface 10*b* are in the same position. However, in FIG. 8, the grooves 11 provided on the first surface 10*a* and the grooves 11 provided on the second surface 10*b* only overlap with each other at points, and the overlapped portion does not extend continuously in the direction in which the bent portion 12 extends. Therefore, the corrugated fin 10 according to the present embodiment has a high rigidity with respect to the direction in which the bent portion 12 extends.

In this example, regarding the corrugated fins 10, an analysis result of comparing the respective strengths of the corrugated fin 10 will be described in a case where the grooves 11 are not provided, a case where the grooves 11 are provided along the direction in which the bent portion 12 extends, and a case where the grooves 11 are provided obliquely with respect to the direction in which the bent portion 12 extends.

In the following description, a direction perpendicular to the direction in which the bent portion 12 extends is referred to as a longitudinal direction.

Figure 12:
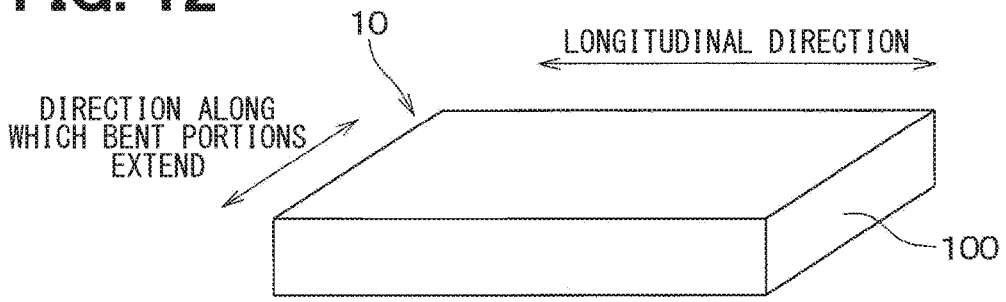
FIG. 12 is a perspective view of a corrugated fin without a groove.

FIG. 12 is a perspective view of the corrugated fin 10 in which the groove 11 is not provided.

Figure 13:
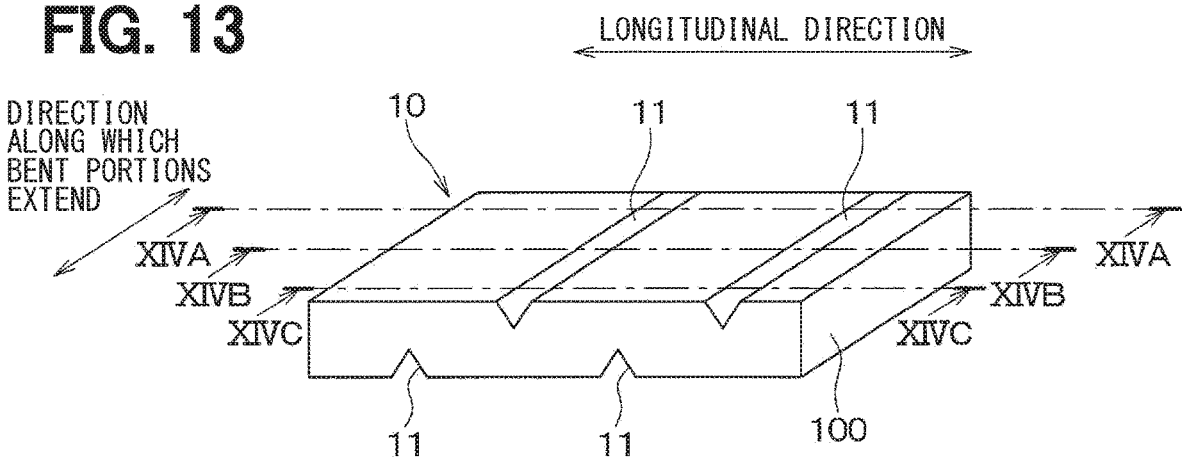
FIG. 13 is a perspective view of a corrugated fin in which grooves are provided along a direction in which a bent portions extend.
Figure 14:
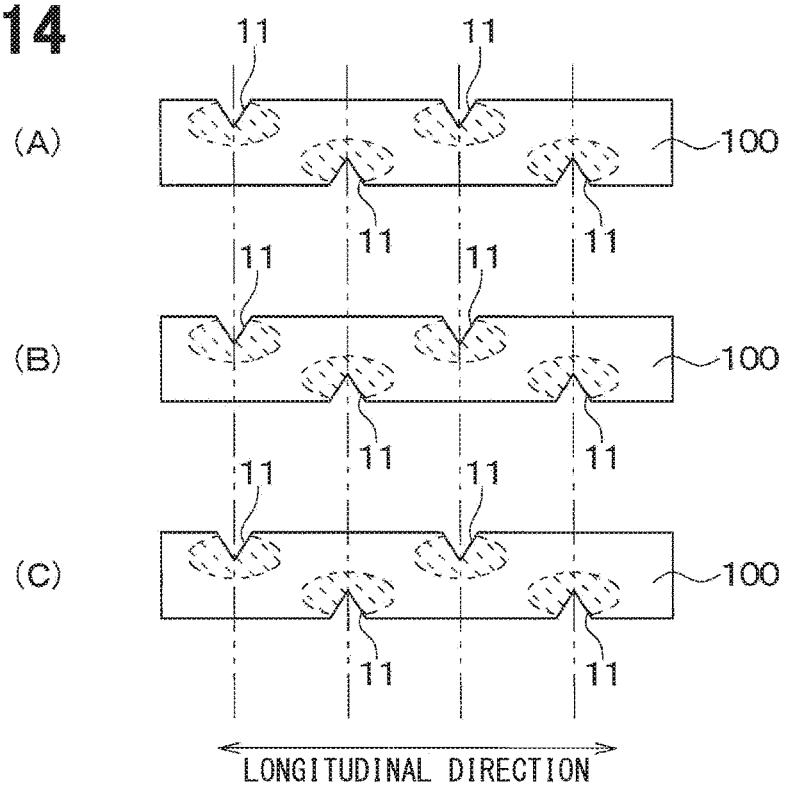
FIG. 14 is cross-sectional views taken along a line XIVA-XIVA, a line XIVB-XIVB, and a line XIVC-XIVC of FIG. 13.

FIG. 13 is a perspective view of the corrugated fin 10 in which the grooves 11 are provided along the direction in which the bent portion 12 extends, as in a reference example to be described later. (A), (B), and (C) in FIG. 14 are cross-sectional views taken along a XIVA-XIVA, a line XIVB-XIVB, and a line XIVC-XIVC of FIG. 13, respectively. As indicated by the two-dot chain lines in (A), (B), and (C) in FIG. 14, when the grooves 11 are provided along the direction in which the bent portion 12 extends, the grooves 11 are positioned in alignment with the direction in which the bent portion 12 extends. In FIG. 14, portions where a stress is concentrated when a bending force, a tensile force, a compression force, or the like is applied to the corrugated fin 10 are hatched by dashed lines. In that case, the portions where the stresses are concentrated are aligned in the direction in which the bent portions 12 extend, corresponding to the positions where the respective grooves 11 are provided.

The bending force is a force acting on the plate member 100 when the bent portion 12 is formed on the plate member 100 configuring the corrugated fin 10. The tensile force is a force acting on the plate member 100 when the plate member 100 is pulled in the longitudinal direction. The compression force is a force acting on the plate member 100 when the corrugated fin 10 is compressed in a vertical direction with respect to the bent portion 12.

Figure 15:
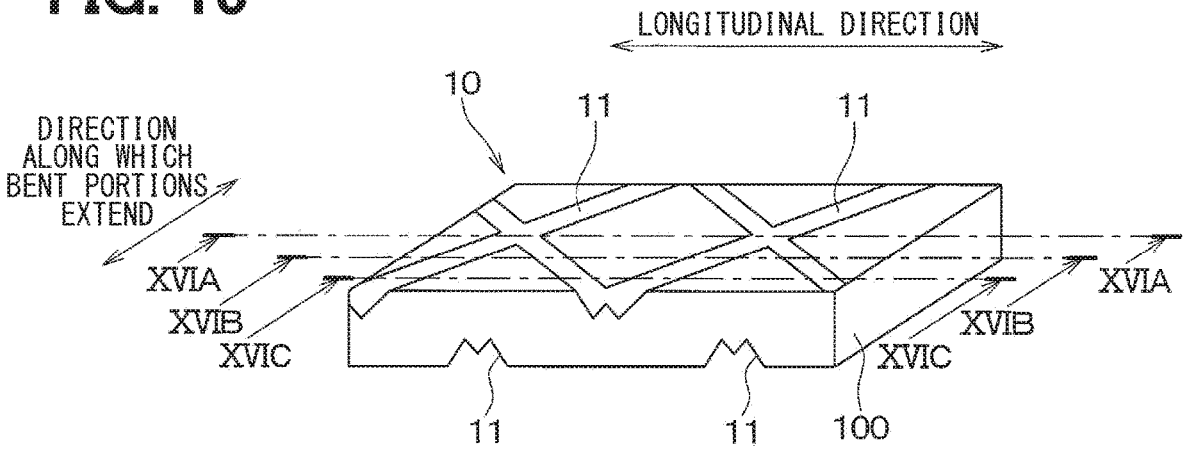
FIG. 15 is a perspective view of a corrugated fin in which grooves are provided obliquely to a direction in which the bent portions extend.
Figure 16:
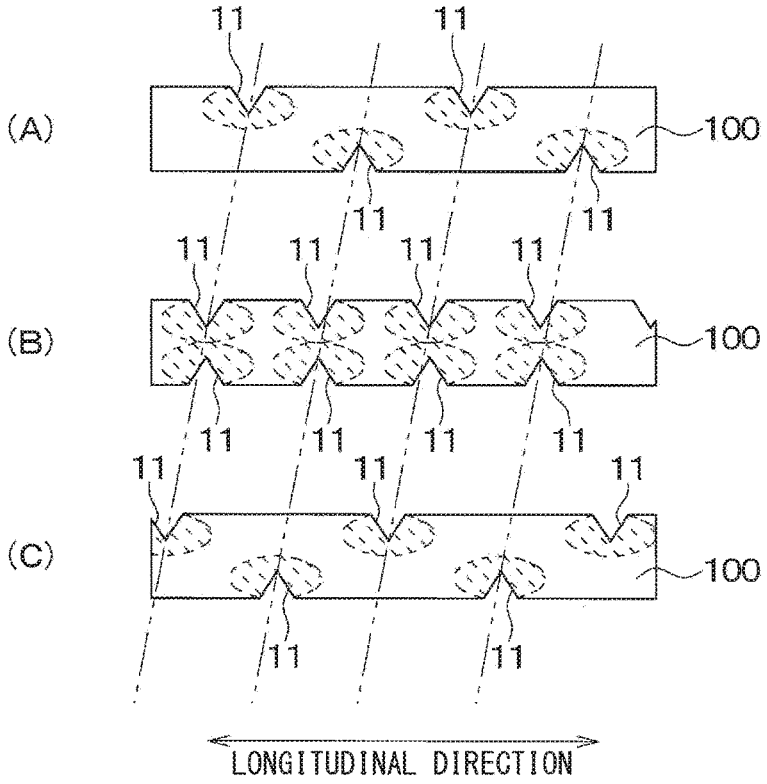
FIG. 16 is a cross-sectional views taken along a line XVIA-XVIA, a line XVIB-XVIB, and a line XVIC-XVIC of FIG. 15.

FIG. 15 is a perspective view of the corrugated fin 10 in which the grooves 11 are provided obliquely with respect to the direction in which the bent portion 12 extends, as in the present embodiment. (A), (B), and (C) in FIG. 16 are cross-sectional views taken along a line XVIA-XVIA, a line XVIB-XVIB, and a line XVIC-XVIC of FIG. 15, respectively. As shown in (A), (B), and (C) in FIG. 16, when the grooves 11 are provided obliquely to the direction in which the bent portion 12 extends, the grooves 11 is formed so as to be gradually offset in the longitudinal direction toward the direction in which the bent portions 12 extend. Also, in FIG. 16, when a bending force, a tensile force, a compression force, or the like is applied to the corrugated fin 10, portions where a stress is concentrated is hatched by dashed lines. In that case, the portions where the stress is concentrated is positioned so as to be gradually offset in the longitudinal direction toward the direction in which the bent portion 12 extends, corresponding to each groove 11.

Figure 17:
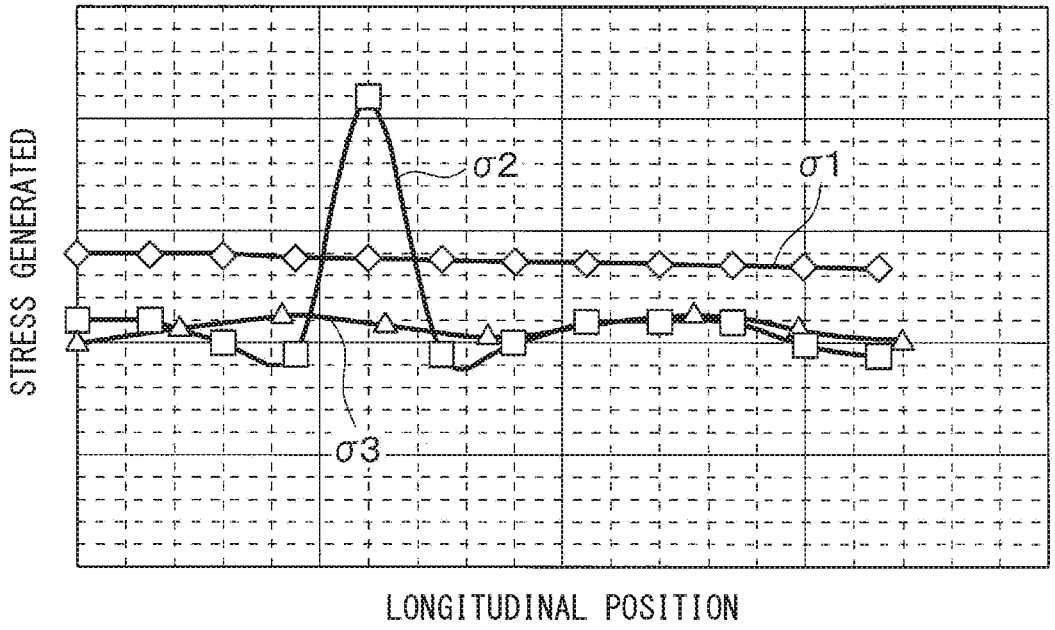
FIG. 17 is an analysis diagram showing a stress generated according to a position of the corrugated fin in a longitudinal direction when a load is applied to the corrugated fin shown in FIGS. 12, 13, and 14.

FIG. 17 shows an analysis result when a bending force, a tensile force, a compression force, or the like is applied to each corrugated fin 10 described with reference to FIGS. 12 to 16.

As represented by diamond-shaped plots and a solid line al in FIG. 17, the stress generated in the corrugated fin 10 is substantially uniform at each position in the longitudinal direction in the corrugated fin 10 in which the groove 11 is not provided.

As represented in square plots and a solid line σ2 in FIG. 7, the corrugated fin 10 having the groove 11 along the direction in which the bent portion 12 extends has a large stress generated at a predetermined position in the longitudinal direction. The position corresponds to the position where the groove 11 is provided in the corrugated fin 10.

On the other hand, as represented by triangular plots and a solid line σ3 in FIG. 17, in the corrugated fin 10 in which the grooves 11 are provided obliquely to the direction in which the bent portion 12 extends, the stress generated in the corrugated fin 10 is substantially uniform at each position in the longitudinal direction. As shown in (A), (B), and (C) in FIG. 16, the corrugated fin 10 is configured such that the grooves 11 gradually deviate in the longitudinal direction toward the direction in which the bent portion 12 extends. In other words, when a bending force, a tensile force, a compression force, and the like is applied to the corrugated fin 10, the stress generated in the corrugated fin 10 becomes substantially uniform at each position in the longitudinal direction because the stress is dispersed in the longitudinal direction. Therefore, it is conceivable that the corrugated fin 10 has a high rigidity against the bending force, the tensile force, the compression force, and the like.

Next, an example of a method of forming the corrugated fin 10 according to the present embodiment will be described.

Figure 18:
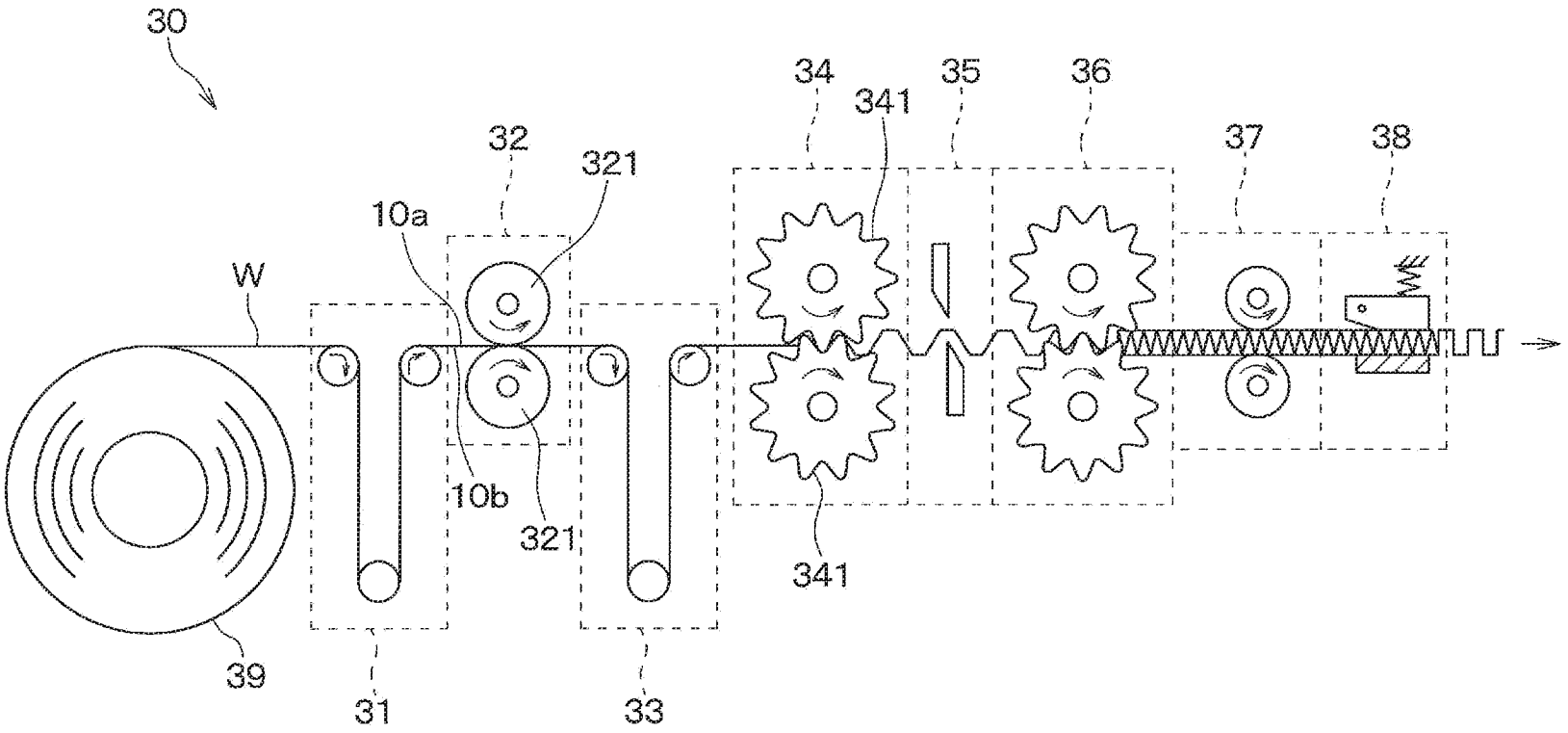
FIG. 18 is a schematic view showing an example of a corrugated fin forming process.

FIG. 18 shows an example of a forming device 30 for forming the corrugated fin 10 according to the present embodiment. The forming device 30 includes a first tension device 31, a groove providing roller device 32, a second tension device 33, a forming roller device 34, a cutting device 35, a feeding device 36, a correction device 37, a brake device 38, and the like.

In the following description, the plate member 100 in a state before the corrugated fin 10 is formed is referred to as a workpiece W.

In a process of forming the corrugated fin 10, the workpiece W is taken out from a material roll 39. The first tension device 31 applies a predetermined tension to the workpiece W. As a result, the workpiece W is extended into a flat state.

Next, the workpiece W passes through a groove providing roller 321 included in the groove providing roller device 32. The groove providing roller 321 provides multiple grooves 11 on both surfaces of one surface 10*a* (that is, the first surface 10*a*) of the workpiece W in the thickness direction and the other surface 10*b* (that is, the second surface 10*b*) of the workpiece W in the thickness direction. Subsequently, the second tension device 33 applies a predetermined tension to the workpiece W to extend the workpiece W into a flat state.

Figure 19:
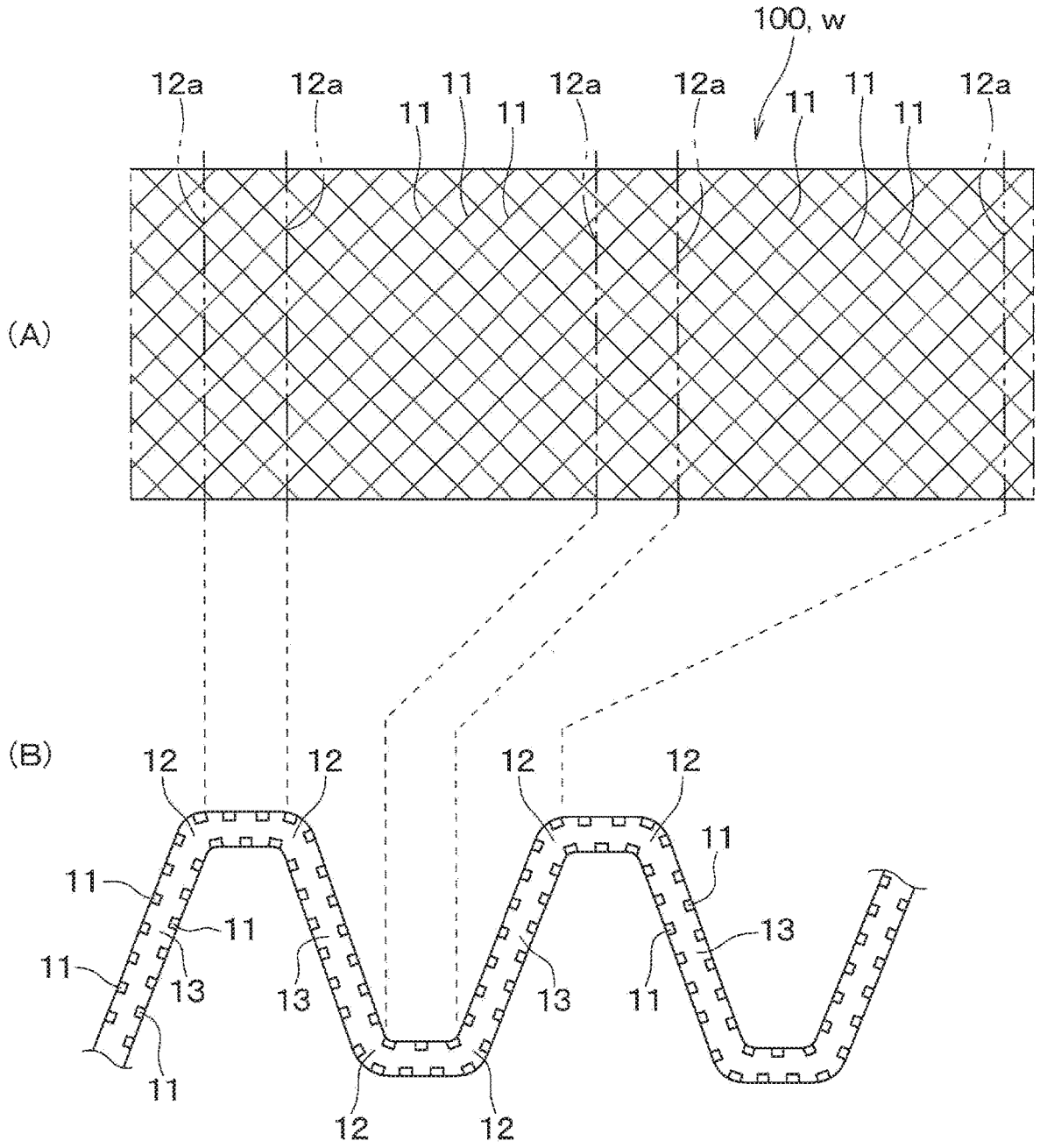
FIG. 19 is a schematic view showing an example of the corrugated fin forming process.

Next, the workpiece W passes through a gear-shaped forming roller 341 included in the forming roller device 34. The forming roller 341 bends the workpiece W into a corrugated plate-shape. As a result, as shown in FIG. 19, the workpiece W is formed into a corrugated plate-shape and has a shape close to the corrugated fin 10. A cutting blade (not shown) for forming the louver 14 is provided on a tooth surface of the forming roller 341. For that reason, when the workpiece W passes through the forming roller device 34, the louvers 14 are formed on the workpiece W.

Subsequently, after the workpiece W is cut to a predetermined length by the cutting device 35, the workpiece W is fed toward the correction device 37 by the feeding device 36. The correction device 37 presses the bent portion 12 formed on the workpiece W in the vertical direction to uniformly correct a distance between the bent portions 12 of the workpiece W, that is, a crest height of the corrugated fin 10.

Next, the workpiece W is fed to the brake device 38. The brake device 38 generates a frictional force that prevents the progression of the workpiece W in contact with the multiple bent portions 12 of the workpiece W. As a result, the workpiece W is compressed by a feeding force generated by the feeding device 36 and a frictional force generated by the brake device 38 so that the bent portions 12 adjacent to each other in the traveling direction come into contact with each other. After passing through the brake device 38, the compressed workpiece W expands by its own elastic force to have a predetermined fin pitch. As a result, the corrugated fin 10 is formed.

Figure 20:
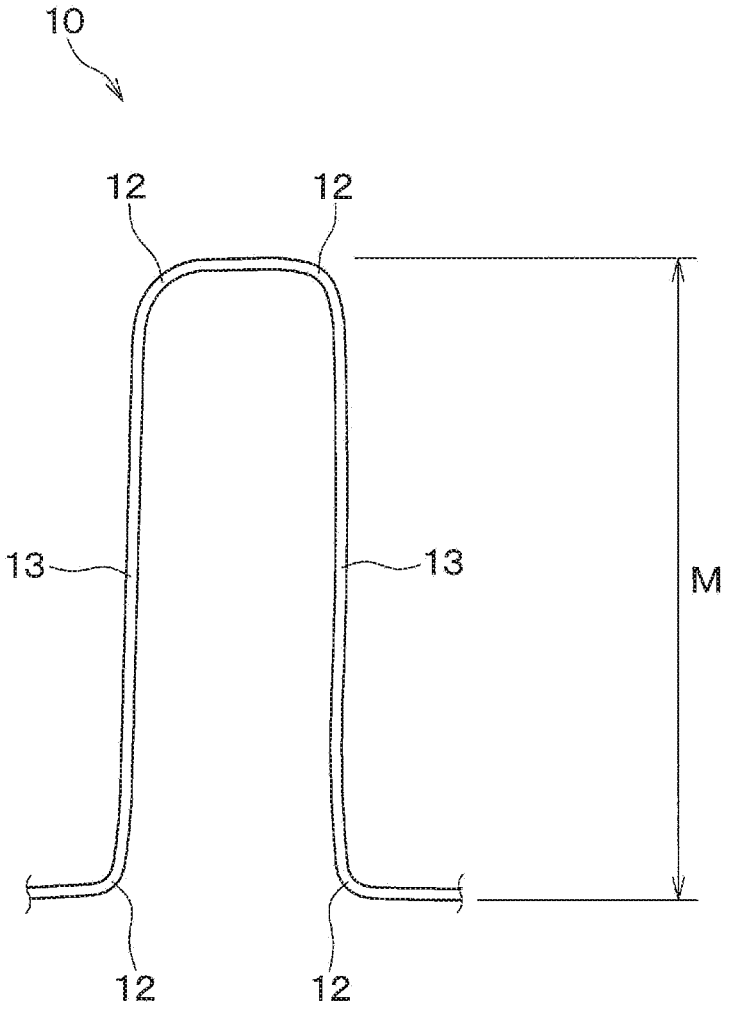
FIG. 20 is a cross-sectional view of the corrugated fin.

FIG. 20 shows a part of a cross section of the corrugated fin 10 formed by the forming device 30. In this state, the bent portion 12 of the corrugated fin 10 is formed into a substantially intended curved surface shape. This makes it possible to manage the crest height M and the fin pitch of the corrugated fin 10 to a constant height.

Figure 21:
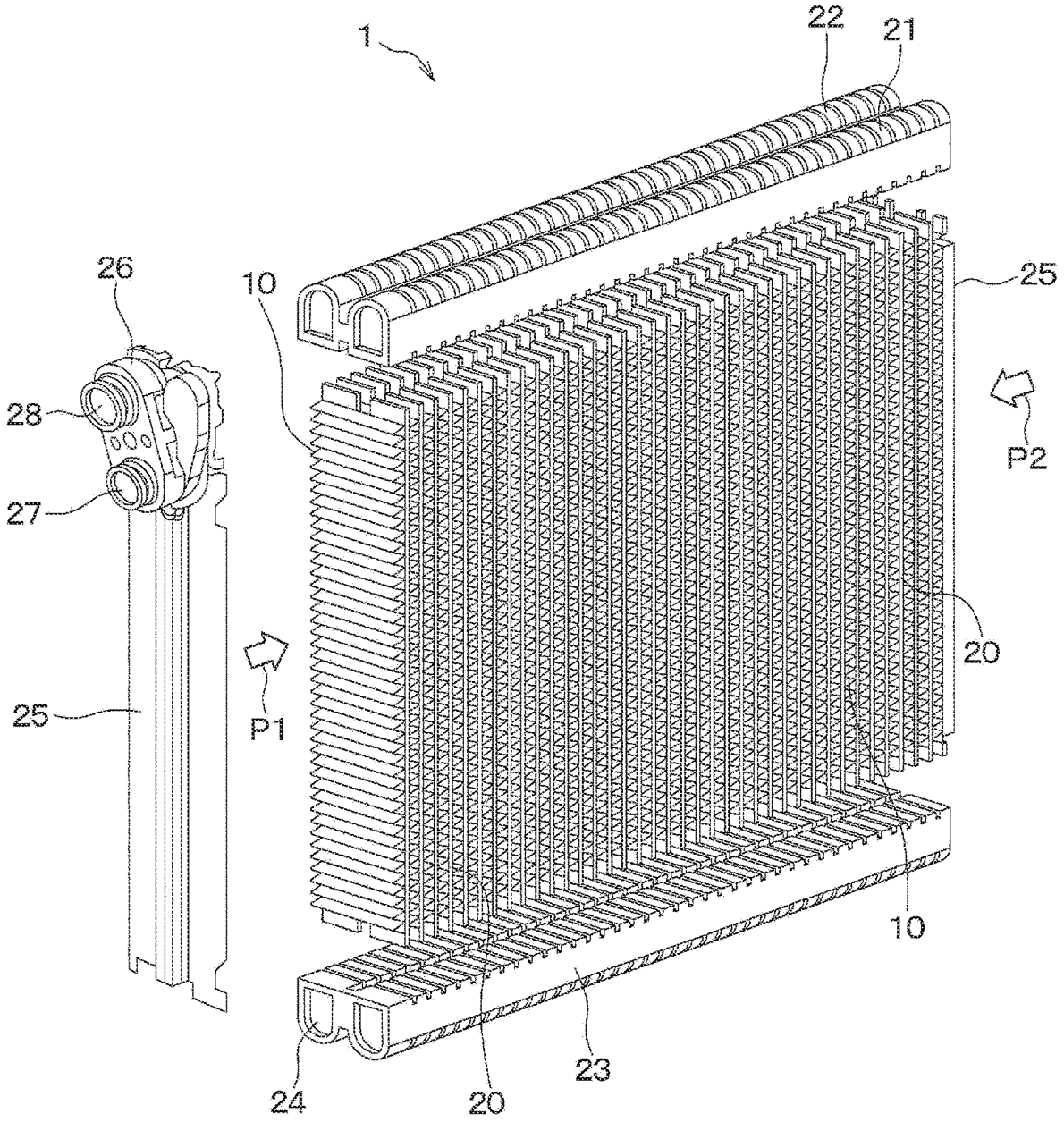
FIG. 21 is a schematic view showing an example of a process of manufacturing the heat exchanger.

Subsequently, as shown in FIG. 21, the multiple corrugated fins 10 are disposed in gaps between the tubes 20. The corrugated fins 10 are pressed by the outer frame member 25 in a vertical direction with respect to the bent portion 12. As a result, all of the corrugated fins 10 and the tube 20 come into contact with each other. Subsequently, after the members such as the first to fourth header tanks 21 to 24 have been assembled together, the members are joined together by brazing.

In this example, in order to compare with the corrugated fins of the first embodiment described above, the corrugated fin in the reference example will be described. The reference example is devised by the present inventors, and is not a conventional technique.

Figure 33:
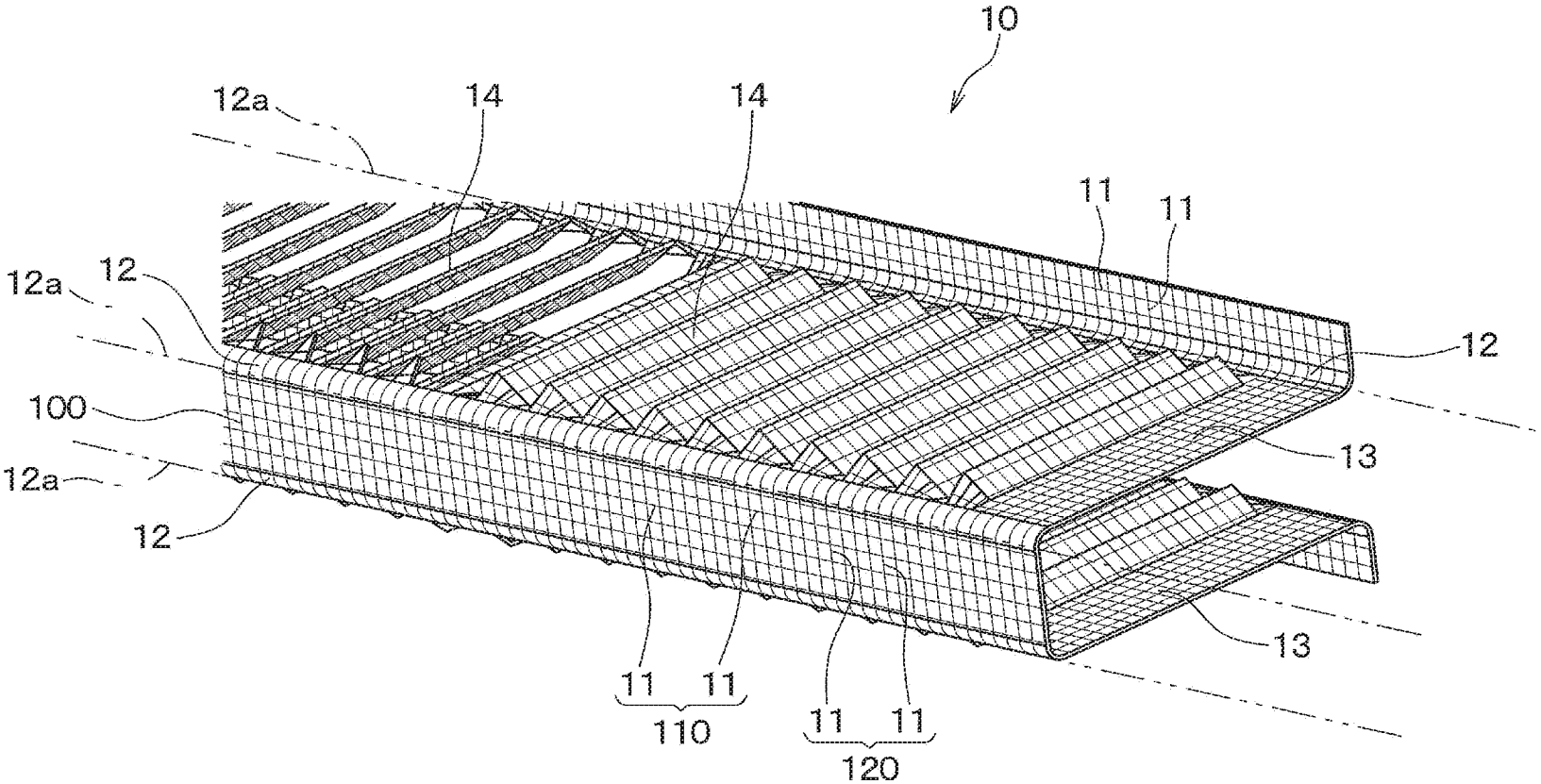
FIG. 33 is a partial enlarged view of a corrugated fin in a reference example.

FIG. 33 is a partially enlarged view of the corrugated fin 10 as the reference example. The corrugated fin 10 in the reference example also has multiple bent portions 12 in which the plate member 100 is bent at predetermined intervals, and a fin main body 13 disposed between the bent portions 12. The fin main body 13 is provided with a louver 14 in which a part of the plate member 100 is cut and protruded.

The multiple grooves 11 are provided in the surface of the corrugated fin 10. The multiple grooves 11 are provided so that the grooves 11 are aligned at predetermined intervals. As a result, the hydrophilicity of the surface of the corrugated fin 10 is increased to improve the drainability. For that reason, the condensed water is prevented from staying on the surface of the corrugated fin 10.

In FIG. 33, the direction in which the bent portions 12 extend is indicated by two-dot chain lines 12*a*. The multiple grooves 11 shown in the reference example include those provided along the direction in which the bent portions 12 extend and those provided in the direction orthogonal to the direction in which the bent portions 12 extend. In the corrugated fin 10 of the reference example, a part of the multiple grooves 11 is provided along the direction in which the bent portions 12 extend, so that the portion of the plate member 100 whose thickness is reduced by the grooves 11 is continuous in the direction in which the bent portions 12 extend.

Figure 34:
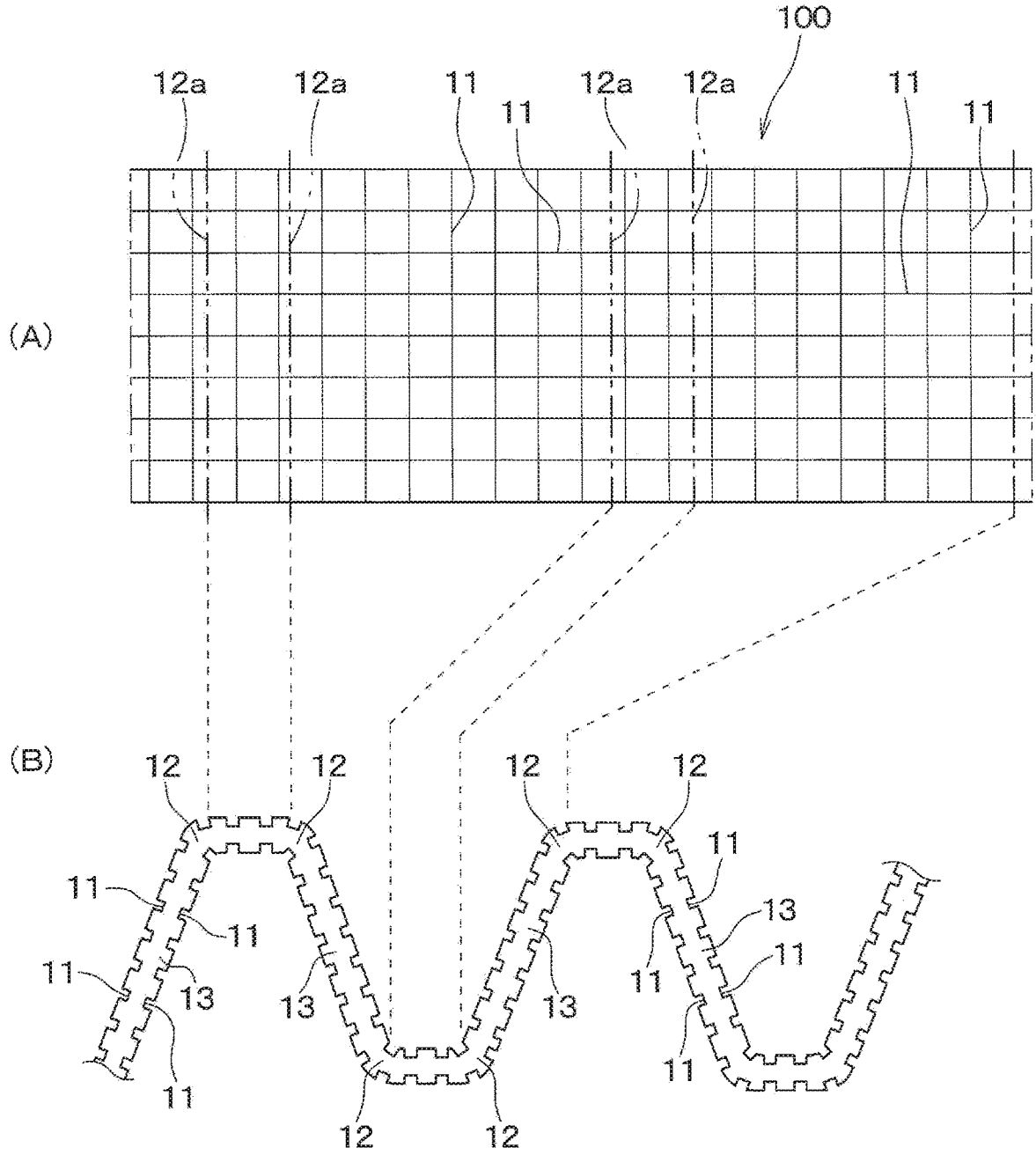
FIG. 34 is a schematic view showing an example of a corrugated fin forming process in the reference example.
Figure 35:
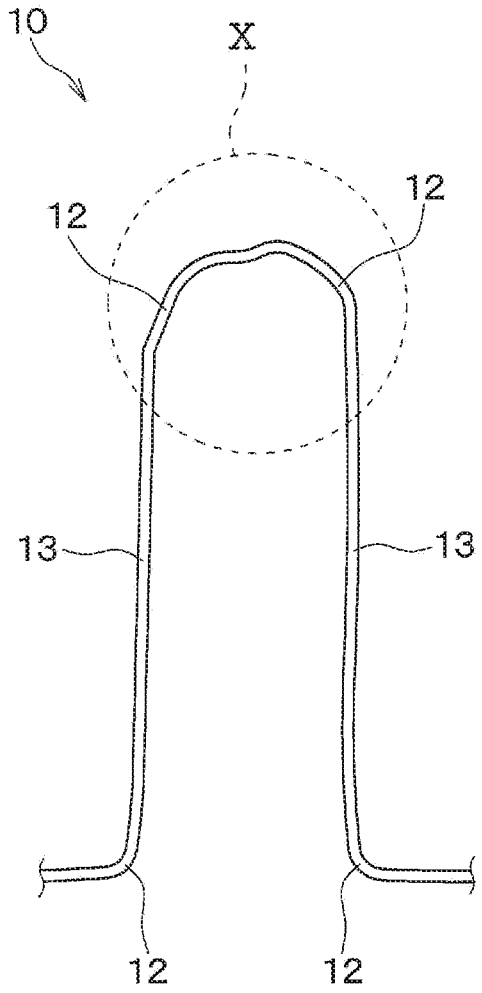
FIG. 35 is a cross-sectional view of a corrugated fin in the reference example.

(A) of FIG. 34 is a plan view of the plate member 100 in a state before the bent portions 12 are formed on the corrugated fin 10. (B) of FIG. 34 is a cross-sectional view showing a halfway state in which the plate member 100 is bent at portions of two-dot chain lines 12*a* in (A) of FIG. 34 to form the bent portions 12 on the corrugated fin 10. As shown in (A) and (B) in FIG. 34, at the time of forming the corrugated fin 10, after the plate member 100 is bent to form the bent portions 12, there is a step of changing an angle of the bent portions 12 to adjust an interval between the fin main bodies 13. At that time, if the grooves 11 are continuously provided along the direction in which the bent portions 12 of the corrugated fin 10 extend, there is a problem that the corrugated fin 10 buckles at the bent portion 12 as indicated by a dashed line X in FIG. 35, and the curved surface of the bent portion 12 has an intermittent shape.

Figure 36:
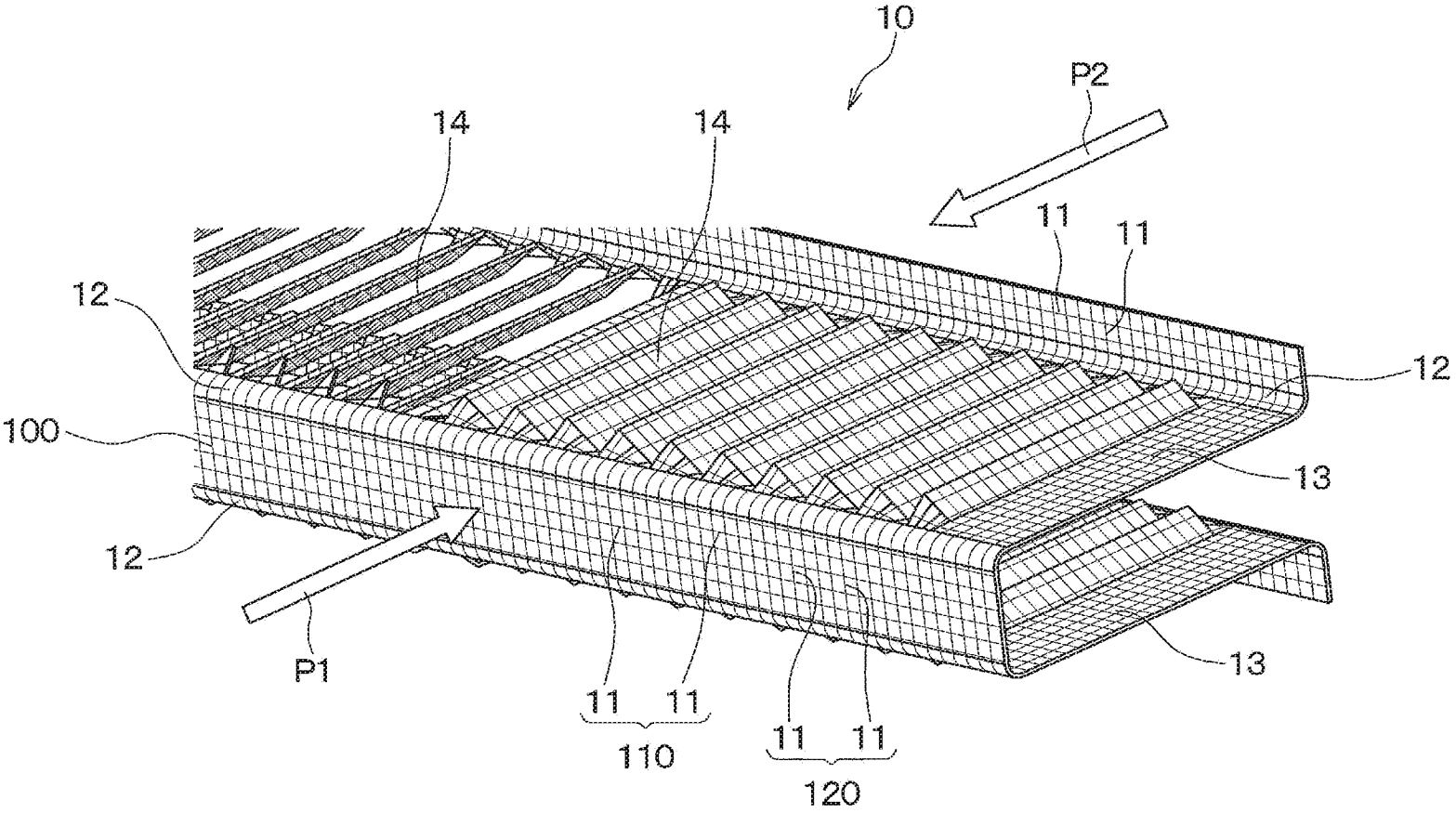
FIG. 36 is a schematic view showing an example of a corrugated fin forming process in the reference example.
Figure 37:
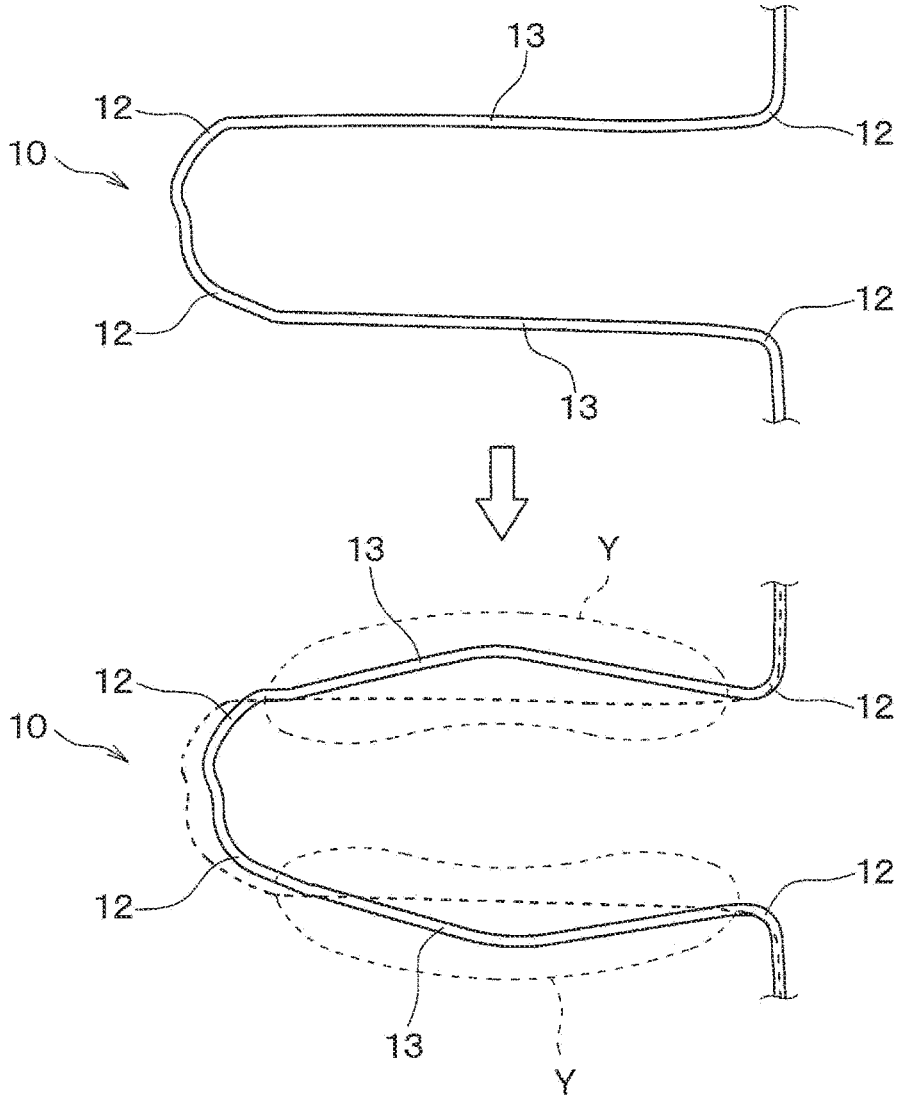
FIG. 37 is a cross-sectional view of the corrugated fin in the reference example.

Further, as indicated by arrows P1 and P2 in FIG. 36, when the corrugated fin 10 is formed and when the heat exchanger is manufactured, there are a step of compressing the corrugated fin 10 in a vertical direction with respect to the bent portion 12 in order to make the crest height of the corrugated fin 10 uniform, and a step of compressing the fins and the tubes in a stacking direction. At this time, if the grooves 11 are continuously provided along the direction in which the bent portions 12 of the corrugated fin 10 extend, there is a problem that the corrugated fin 10 buckles at the fin main body 13 as indicated by dashed lines Y in FIG. 37. In that case, the heat exchanger 1 is hardly manufactured by disposing the multiple corrugated fins 10 in gaps between the tubes 20 because the crest height and fin pitch of the corrugated fins 10 cannot be controlled.

On the other hand, in the corrugated fin 10 of the first embodiment described above, in a cross-sectional view parallel to the direction in which the bent portions 12 extend, since the second thick portion T2 thicker than the first thick portion T1 is intermittently disposed, the rigidity of the fin in the direction in which the bent portions 12 extend is increased. For that reason, in the first embodiment, the corrugated fin 10 is prevented from buckling in the bent portion 12 or the fin main body 13 even when a bending force, a tensile force, a compression force, or the like is applied at the time of forming the corrugated fin 10, and the corrugated fin 10 is formed into a substantially intended shape as shown in FIG. 20. Therefore, in the first embodiment, the crest height and the fin pitch of the corrugated fin 10 can be controlled to a constant height.

Figure 38:
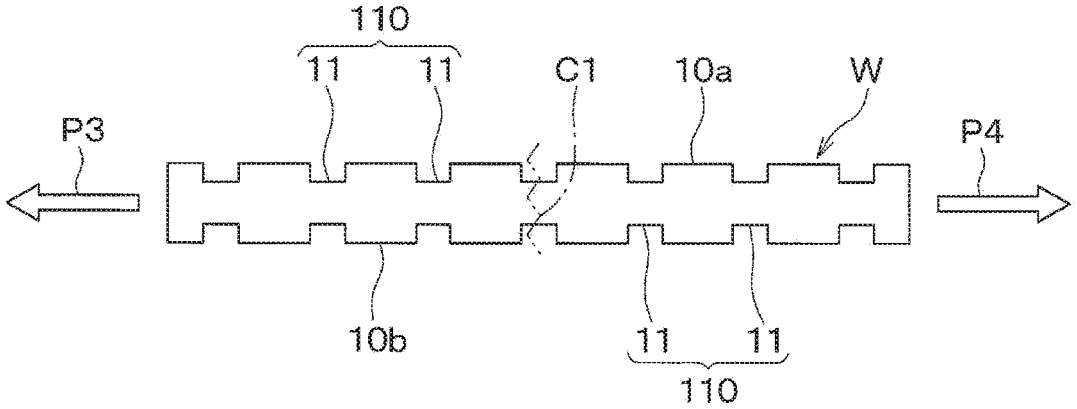
FIG. 38 is a cross-sectional view of the corrugated fin in the reference example.

On the other hand, in the reference example, as shown in FIG. 38, the multiple grooves 11 configuring the first groove group 110 in the first surface 10*a* and the multiple grooves 11 configuring the first groove group 110 in the second surface 10*b* are provided at positions overlapping with each other in the thickness direction. Alternatively, the multiple grooves 11 configuring the first groove group 110 in the first surface 10*a* and the multiple grooves 11 configuring the first groove group 110 in the second surface 10*b* are formed in such a manner that a positional deviation when viewed in the thickness direction occurs. For that reason, in the reference example, the first thick portion T1 having a small plate thickness is continuous in the direction in which the bent portions 12 extend. Therefore, in the reference example, as indicated by arrows P3 and P4 in FIG. 38, when a tensile force acts on the workpiece W in the vertical direction of the bent portion 12 at the time of forming the corrugated fin 10, there is a problem that a crack occurs in the workpiece W as indicated by a one-dot chain line C1 in FIG. 38. In that case, the corrugated fin 10 and the heat exchanger 1 are hardly manufactured.

On the other hand, in the first embodiment, as shown in FIGS. 6 to 9, the grooves 11 configuring the first groove group 110 in one surface 10*a* of the corrugated fin 10 in the thickness direction and the grooves 11 configuring the first groove group 110 in the other surface 10*b* are provided at positions offset from each other in the thickness direction. This prevents the first thick portion T1 having a small plate thickness from being continuous in the corrugated fin 10 in the cross-sectional view parallel to the direction in which the bent portions 12 extend. For that reason, in the corrugated fin 10, the rigidity of the fin in the direction in which the bent portions 12 extend is increased. Therefore, in the first embodiment, even if a tensile force acts on the workpiece Win the vertical direction of the bent portion 12 at the time of forming the corrugated fin 10, the workpiece W can be prevented from being cracked.

Further, in the first embodiment, the following operation and effects can be obtained.

In the first embodiment, the multiple grooves 11 provided in the corrugated fin 10 extend obliquely with respect to the direction in which the bent portions 12 extend. According to the above configuration, as shown by the triangular plots and the solid line σ3 in FIG. 17, when the bending force, the tensile force, the compression force, and the like act at the time of forming the corrugated fin 10, the stress is dispersed in the longitudinal direction, and the stress generated in the corrugated fin 10 becomes substantially uniform at each position in the longitudinal direction. Therefore, the corrugated fin 10 according to the first embodiment can more reliably prevent the corrugated fin 10 from buckling in the bent portions 12 and the fin main body 13 at the time of forming the corrugated fin 10.

In the first embodiment, the multiple grooves 11 are provided on both surfaces of the first surface 10*a* and the second surface 10*b* of the corrugated fin 10. According to the above configuration, the drainability of both sides of the corrugated fin 10 in the thickness direction can be improved.

As shown in FIG. 5, in the first embodiment, the multiple grooves 11 are provided symmetrically with respect to an imaginary plane VS on which the bent portions 12 have the centers in, and which is perpendicular to, the extending direction of the bent portions 12. According to the above configuration, when the multiple grooves 11 are provided on the workpiece W by the groove forming roller 321 or the like at the time of forming the corrugated fin 10, the force acting on the workpiece W from the groove forming roller 321 becomes uniform on the left and right sides. Therefore, the workpiece W can be prevented from twisting with respect to the feeding direction of the groove forming roller 321.

In the first embodiment, it is preferable that the angle θ1 formed by the direction in which the multiple grooves 11 extend and the imaginary plane VS falls in a range of $20° \leq \theta 1 \leq 70°$.

This makes it possible to disperse the stress generated in the corrugated fin 10 in the longitudinal direction and to generate the stress substantially uniformly at each position in the longitudinal direction in the corrugated fin 10 when the bending force, the tensile force, the compression force, or the like acts on the corrugated fin 10 at the time of forming the corrugated fin 10. This makes it possible to more reliably prevent the corrugated fin 10 from buckling in the bent portion 12 and the fin main body 13 at the time of forming the corrugated fin 10.

The first groove group 110 and the second groove group 120 are provided in the surface of the corrugated fin 10 according to the first embodiment. The multiple grooves 11 configuring the first groove group 110 and the multiple grooves 11 configuring the second groove group 120 extend so as to intersect with each other. According to the above configuration, the grooves 11 configuring the first groove group 110 and the grooves 11 configuring the second groove group 120 are provided so as to be connected to each other from the fin main body 13 over the bent portion 12. For that reason, as indicated by the arrows WF1 in FIG. 10, the condensed water generated in the fin main body 13 of the corrugated fin 10 easily flows to the bent portion 12 through the first groove group 110 and the second groove group 120. Then, as indicated by the arrow WF2 in FIG. 11, the condensed water flowing into the bent portions 12 flows down through the holes of the louvers 14, the walls of the tubes 20, and the like. Therefore, the heat exchanger 1 prevents condensed water from staying in the fin main body 13 of the corrugated fin 10, thereby being capable of preventing an increase in the ventilation resistance between the gaps between the corrugated fins and enhancing the heat exchanging performance.

In the first embodiment, the multiple grooves 11 are provided at least in the surface of the louver 14. According to the above configuration, with the provision of the multiple grooves 11 in the louver 14 which exhibits the most heat exchanging performance among the corrugated fins 10, the drainability of the louver 14 can be improved, and the condensed water can be prevented from staying on the surface of the louver 14. Therefore, the heat exchanger 1 can prevent an increase in the ventilation resistance in the louvers 14 and enhance the heat exchanging performance.

The heat exchanger 1 according to the first embodiment is used as an evaporator. In the evaporator, the condensed water is generated on the surface of the corrugated fin 10 when the air is cooled. In that case, the heat exchanger 1 can enhance the heat exchanging performance as an evaporator by improving the drainability of the condensed water generated on the surface of the corrugated fin 10.

As shown in FIG. 4, in the first embodiment, it is preferable that the multiple grooves 11 have a width w of 10 to 50 μm, a depth h of 10 μm or more, and a pitch p of 50 to 200 μm. According to the above configuration, in the heat exchanger 1, the provision of the multiple grooves 11 make it possible to increase the hydrophilicity of the surface of the corrugated fin 10, and to improve the drainability of the condensed water generated on the surface of the corrugated fin 10.

Second Embodiment

A second embodiment will be described with reference to FIGS. 22 to 25. In the second embodiment, the configuration of grooves 11 is changed from that of the first embodiment, and the remaining configurations are the same as those of the first embodiment, and therefore, only portions different from the first embodiment will be described.

Figure 22:
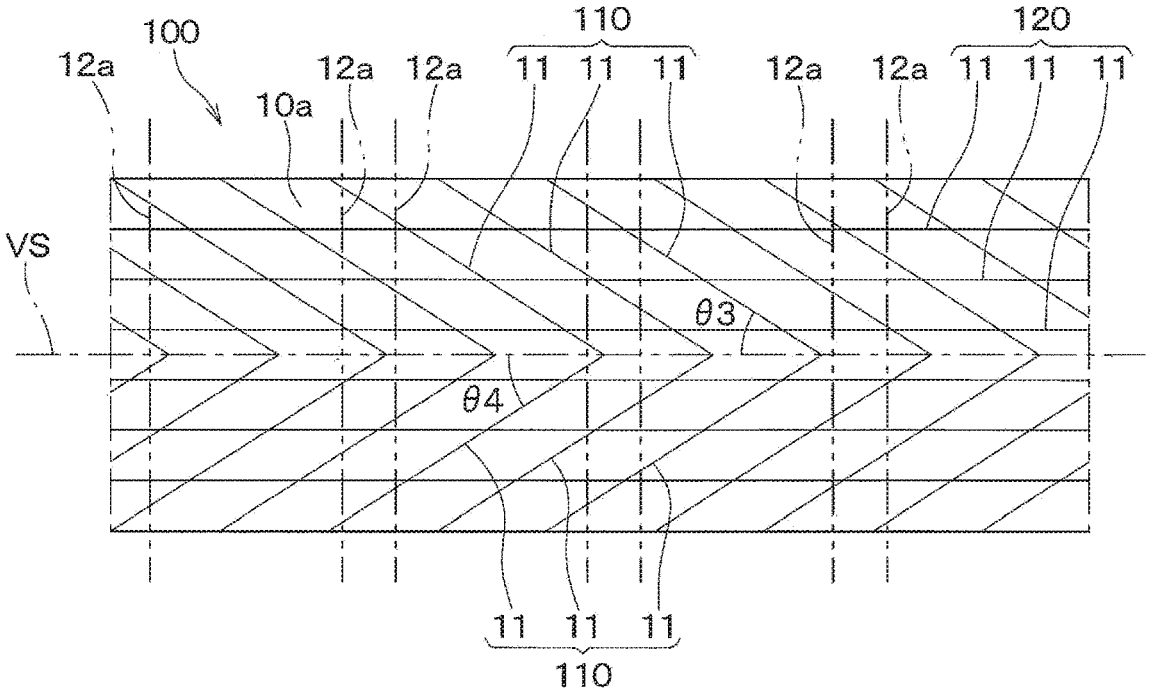
FIG. 22 is a plan view showing a front surface of a plate member configuring a corrugated fin according to a second embodiment.

FIG. 22 is a plan view of a first surface 10*a* of a plate member 100 configuring a corrugated fin 10 according to the second embodiment. A first groove group 110 and a second groove group 120 are provided on the first surface 10*a* of the corrugated fin 10. In FIG. 22, angles formed by an imaginary plane VS and directions in which the multiple grooves 11 configuring the first groove group 110 extend are indicated by 83 and 84. The multiple grooves 11 configuring the first groove group 110 in the first surface 10*a* are preferably provided so as to be in a range of $20° \leq \theta 3 \leq 70°$ and $-20° \geq \theta 4 \geq -70°$.

The second groove group 120 includes the multiple grooves 11 extending in a direction intersecting with the first groove group 110. In the second embodiment, the multiple grooves 11 configuring the second groove group 120 extend in parallel with the imaginary plane VS. In other words, an angle formed by the multiple grooves 11 configuring the second groove group 120 and the imaginary plane VS is substantially 0°.

Figure 23:
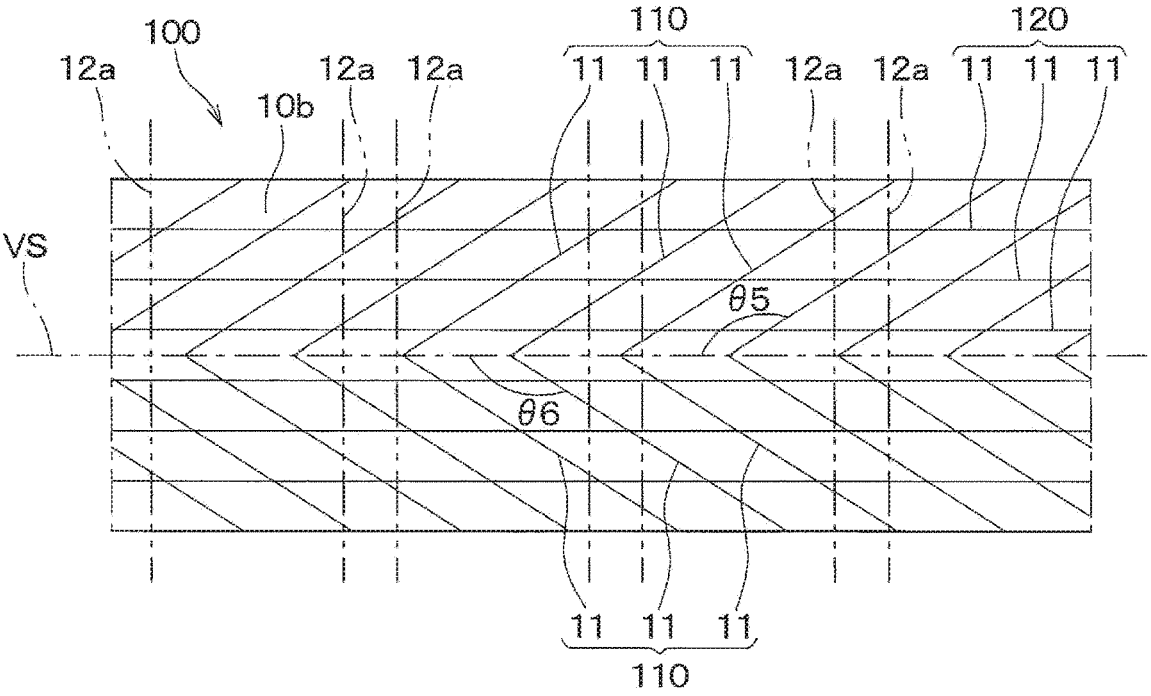
FIG. 23 is a plan view showing a back surface of the plate member configuring the corrugated fin according to the second embodiment.

FIG. 23 is a plan view of the second surface 10*b* of the plate member 100 configuring the corrugated fin 10 according the second embodiment. The second surface 10*b* of the corrugated fin 10 is also provided with the first groove group 110 and the second groove group 120. In FIG. 23, the angles formed by the imaginary plane VS and the directions in which the multiple grooves 11 configuring the first groove group 110 extend are indicated by θ5 and θ6. The multiple grooves 11 configuring the first groove group 110 in the second surface 10*b* are preferably provided so as to be in the range of $110° \leq \theta 5 \leq 160°$ and $-110° \geq \theta 6 \geq -160°$. In other words, θ3 and θ5 are different angles from each other, and θ4 and θ6 are different angles from each other.

The multiple grooves 11 configuring the second groove group 120 provided in the second surface 10*b* also extend in parallel with the imaginary plane VS. In other words, an angle formed by the multiple grooves 11 configuring the second groove group 120 and the imaginary plane VS is substantially 0°.

Figure 24:
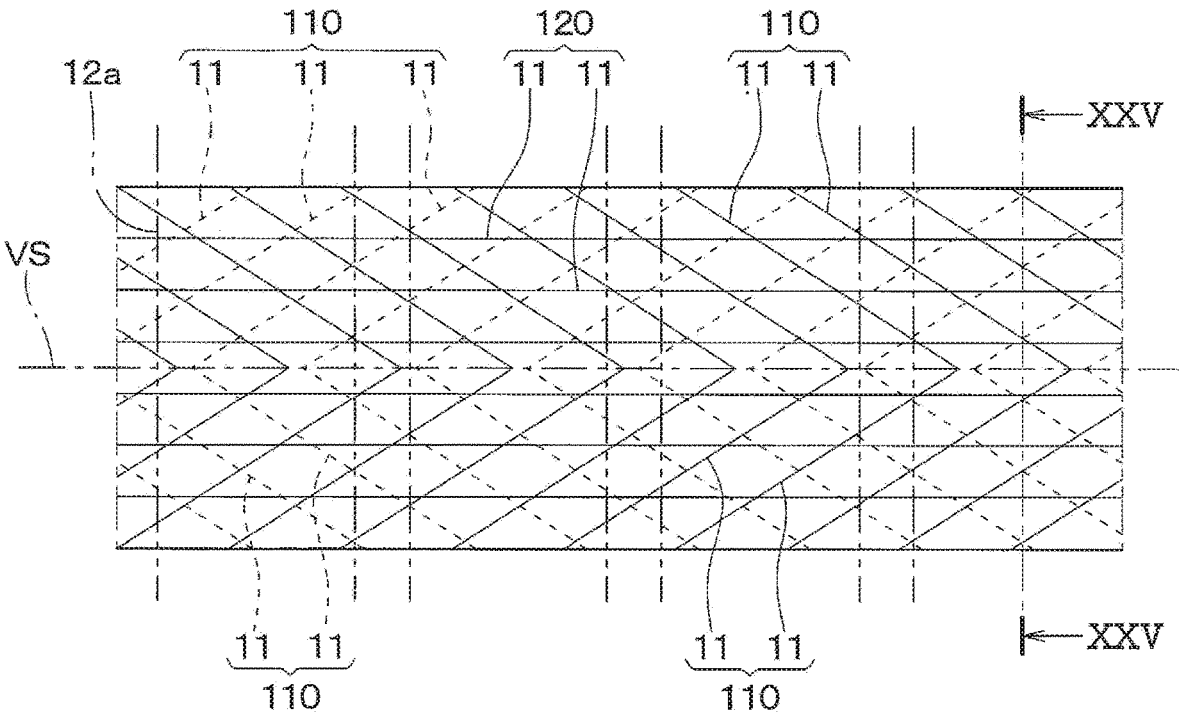
FIG. 24 is a plan view showing both the front surface and the back surface of the plate member configuring the corrugated fin according to the second embodiment.

In FIG. 24, the first groove group 110 and the second groove group 120 provided in the first surface 10*a* of the corrugated fin 10 are indicated by solid lines, and the first groove group 110 and the second groove group 120 provided in the second surface 10*b* are indicated by dashed lines. As described above, θ3 and θ5 are different angles from each other, and θ4 and θ6 are different angles from each other. Therefore, the grooves 11 configuring the first groove group 110 provided in the first surface 10*a* of the corrugated fin 10 and the grooves 11 configuring the first groove group 110 provided in the second surface 10*b* have different angles with respect to the direction in which the bent portion 12 extends when viewed from the same thickness direction. For that reason, the grooves 11 configuring the first groove group 110 in the first surface 10*a* and the grooves 11 configuring the first groove group 110 in the second surface 10*b* are provided at positions offset from each other.

Figure 25:
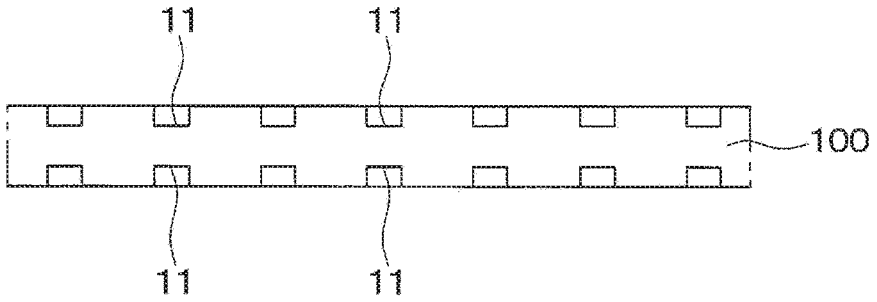
FIG. 25 is an enlarged view of a cross section taken along a line XXV-XXV of FIG. 24.

FIG. 25 is an enlarged view of a cross section taken along a line XXV-XXV in FIG. 24. In FIG. 25, the grooves 11 configuring the first groove group 110 provided in the first surface 10*a* and the grooves 11 configuring the first groove group 110 provided in the second surface 10*b* only overlap with each other at points, and the overlapped portions do not extend continuously in the direction in which the bent portion 12 extends. The portion where the grooves 11 configuring the second groove group 120 provided in the first surface 10*a* and the grooves 11 configuring the second groove group 120 provided in the second surface 10*b* overlap with each other extends perpendicularly to the direction in which the bent portion 12 extends, and does not extend continuously in the direction in which the bent portion 12 extends.

In the second embodiment described above, the grooves 11 configuring the first groove group 110 provided in the first surface 10*a* of the corrugated fin 10 and the grooves 11 configuring the first groove group 110 provided in the second surface 10*b* have different angles with respect to the direction in which the bent portion 12 extends when viewed from the same thickness direction. According to the above configuration, even when the pitches of the multiple grooves 11 are extremely small, there is no need to alternately arrange one groove in the thickness direction and the other groove in the thickness direction. For that reason, a configuration in which the grooves 11 configuring the first groove group 110 provided in the first surface 10*a* and the grooves 11 configuring the first groove group 110 provided in the second surface 10*b* are provided at positions offset from each other in the same thickness direction can be easily realized. For that reason, in the cross-sectional view parallel to the direction in which the bent portion 12 extends, the thinner portions of the corrugated fin 10 are prevented from being continuous, so that the rigidity of the corrugated fin 10 increases in the direction in which the bent portion 12 extends. Therefore, similarly to the first embodiment, the second embodiment can also prevent the corrugated fin 10 from buckling in the bent portion 12 and the fin main body 13 at the time of forming the corrugated fin 10 or at the time of manufacturing the heat exchanger 1. In addition, when a tensile force acts on the workpiece W in the vertical direction of the bent portion 12 at the time of forming the corrugated fin 10, the workpiece W can be prevented from cracking. Further, the second embodiment can also exhibit the same operation and effects as those described in the first embodiment.

Third Embodiment

A third embodiment will be described with reference to FIG. 26. In the third embodiment, the configuration of the groove 11 is changed with respect to the first and second embodiments, and the other configurations are the same as those of the first and second embodiments, and therefore, only portions different from those of the first and second embodiments will be described.

Figure 26:
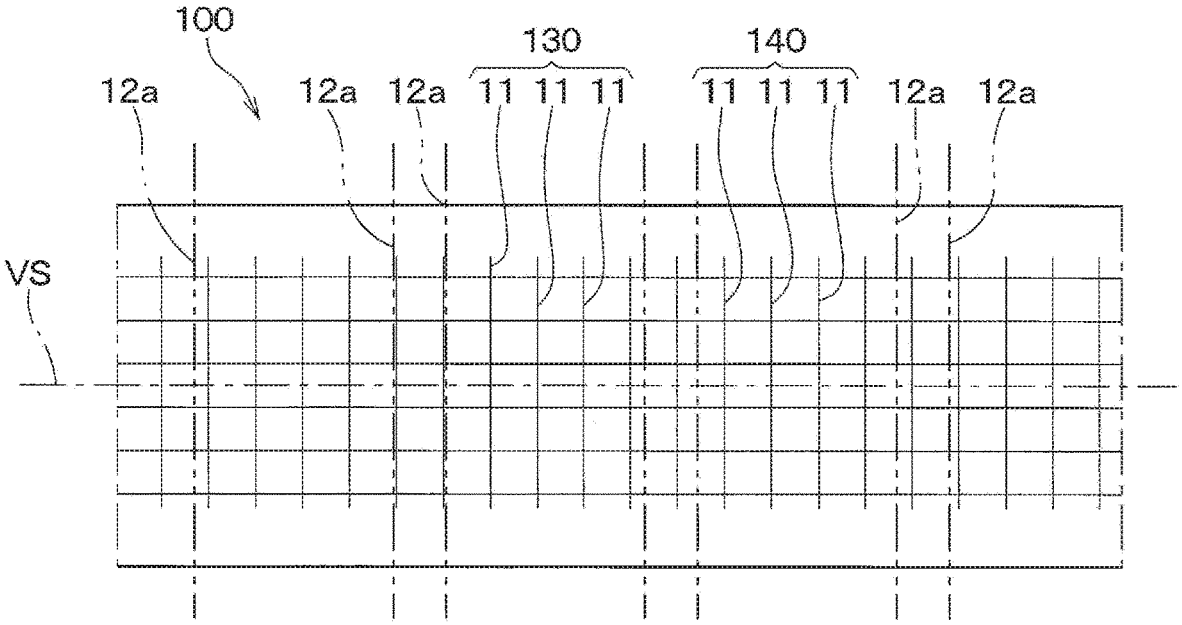
FIG. 26 is a plan view of a plate member configuring a corrugated fin according to a third embodiment.

FIG. 26 is a plan view of a plate member 100 configuring a corrugated fin 10 according to the third embodiment. The corrugated fin 10 according to the third embodiment is provided with a bending direction groove group 130 including the multiple grooves 11 extending along the direction in which the bent portion 12 extends. Further, the corrugated fin 10 is provided with an intersecting direction groove group 140 including the multiple grooves 11 extending in the direction intersecting with the bending direction groove group 130.

The multiple grooves 11 configuring the bending direction groove group 130 are not provided at one end and the other end of the corrugated fin 10 in the direction in which the bent portion 12 extends. As a result, the corrugated fin 10 includes a first thick portion T1 in which the grooves 11 are provided and a second thick portion T2 which is thicker than the first thick portion T1 in a cross-sectional view parallel to the direction in which the bent portion 12 extends. The second thick portion T2 is arranged at one end and the other end in the direction in which the bent portion 12 extends. As a result, the rigidity of the corrugated fin 10 according to the third embodiment is also high in the direction in which the bent portion 12 extends. Therefore, the third embodiment can also exhibit the same operation and effects as those of the first and second embodiments.

Fourth Embodiment

A fourth embodiment will be described with reference to FIGS. 27 to 30. Since the fourth embodiment is the same as the first to third embodiments except that the configuration of the grooves 11 is changed from the first to third embodiments, only portions different from the first to third embodiments will be described.

Figure 27:
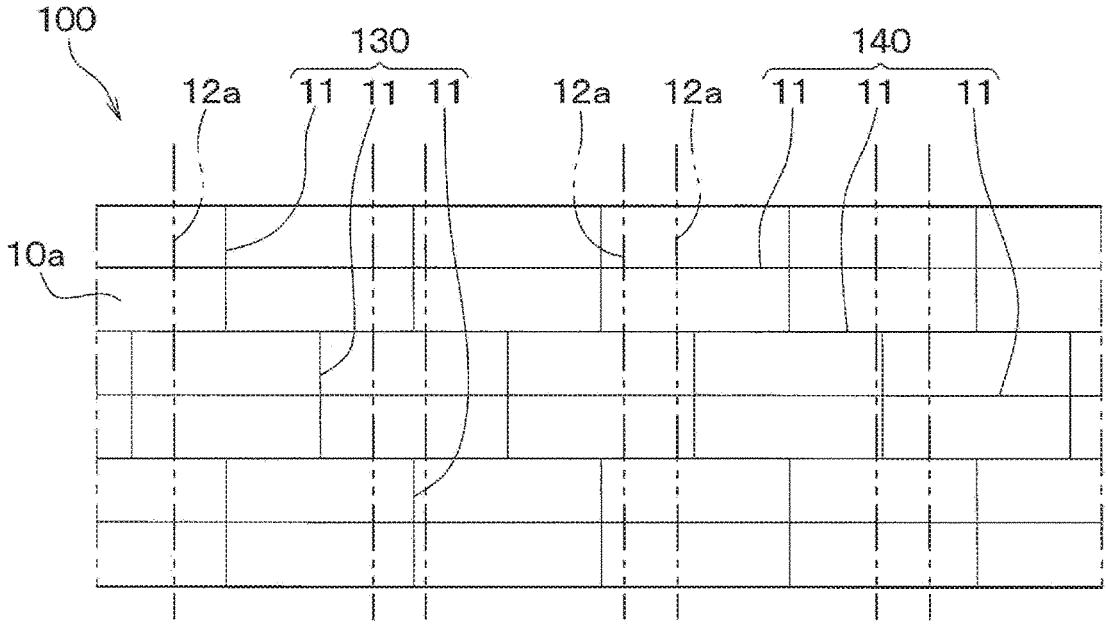
FIG. 27 is a plan view showing a front surface of a plate member configuring a corrugated fin according to a fourth embodiment.

FIG. 27 is a plan view of a plate member 100 configuring a corrugated fin 10 according to the fourth embodiment. The corrugated fin 10 according to the fourth embodiment is also provided with a bending direction groove group 130 including the multiple grooves 11 extending along a direction in which the bent portion 12 extends. Further, the corrugated fin 10 is provided with an intersecting direction groove group 140 including the multiple grooves 11 extending in the direction intersecting with the bending direction groove group 130.

The multiple grooves 11 configuring the bending direction groove group 130 according to the fourth embodiment are provided in a staggered shape. In other words, the multiple grooves 11 configuring the bending direction groove group 130 are provided so as to intermittently extend along the direction in which the bent portion 12 extends. As a result, the corrugated fin 10 can include a first thick portion T1 in which the grooves 11 are provided and a second thick portion T2 which is thicker than the first thick portion T1 in a cross-sectional view parallel to the direction in which the bent portion 12 extends. For that reason, the rigidity of the corrugated fin 10 according to the fourth embodiment is also high in the direction in which the bent portion 12 extends.

Figure 28:
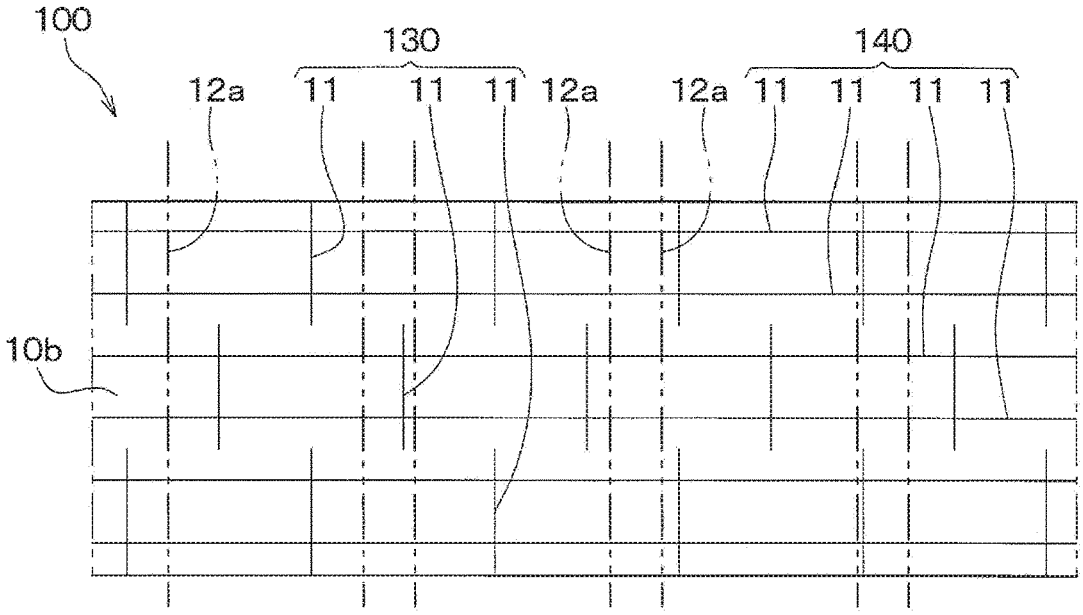
FIG. 28 is a plan view showing a back surface of the plate member configuring the corrugated fin according to the fourth embodiment.

In the fourth embodiment, the multiple grooves 11 are provided on both surfaces of the first surface 10*a* and the second surface 10*b* of the corrugated fin 10. FIG. 27 shows the bending direction groove group 130 and the intersecting direction groove group 140 provided in the first surface 10*a* of the corrugated fin 10. FIG. 28 shows the bending direction groove group 130 and the intersecting direction groove group 140 provided in the second surface 10*b* of the corrugated fin 10.

Figure 29:
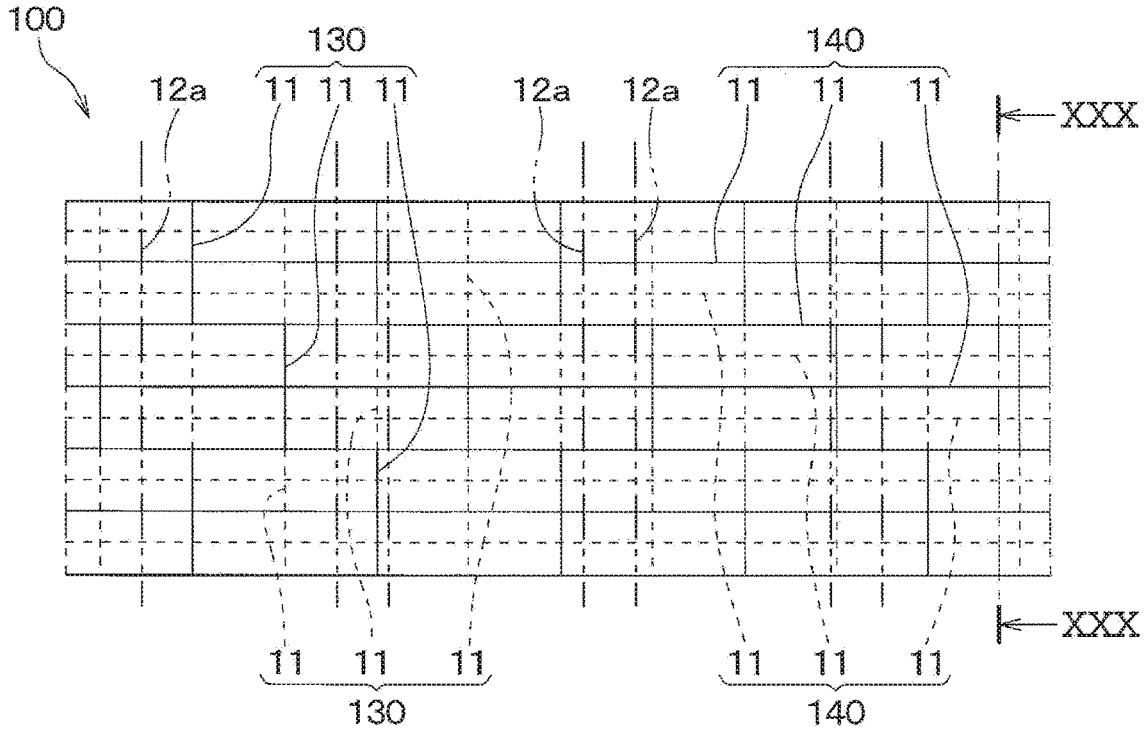
FIG. 29 is a plan view showing both the front surface and the back surface of the plate member configuring the corrugated fin according to the fourth embodiment.

In FIG. 29, the bending direction groove group 130 and the intersecting direction groove group 140 provided in the first surface 10*a* of the corrugated fin 10 are indicated by solid lines, and the bending direction groove group 130 and the intersecting direction groove group 140 provided in the second surface 10*b* are indicated by dashed lines. The grooves 11 configuring the bending direction groove group 130 and the intersecting direction groove group 140 provided in the first surface 10*a* of the corrugated fin 10 and the grooves 11 configuring the bending direction groove group 130 and the intersecting direction groove group 140 provided in the second surface 10*b* are provided at positions offset from each other when viewed in the thickness direction. As a result, the multiple grooves 11 provided in the first surface 10*a* and the multiple grooves 11 provided in the second surface 10*b* overlap with each other at points, and the overlapped portion does not extend continuously in the direction in which the bent portion 12 extends. For that reason, in the corrugated fin 10, the rigidity of the fin in the direction in which the bent portions 12 extend is increased. Therefore, the corrugated fin 10 is prevented from buckling in the bent portion 12 and the fin main body 13 at the time of forming the corrugated fin 10 or at the time of manufacturing the heat exchanger 1. In addition, when a tensile force is applied to the workpiece W in the vertical direction of the bent portion 12 at the time of forming the corrugated fin 10, the plate member 100 can be prevented from cracking.

Figure 30:
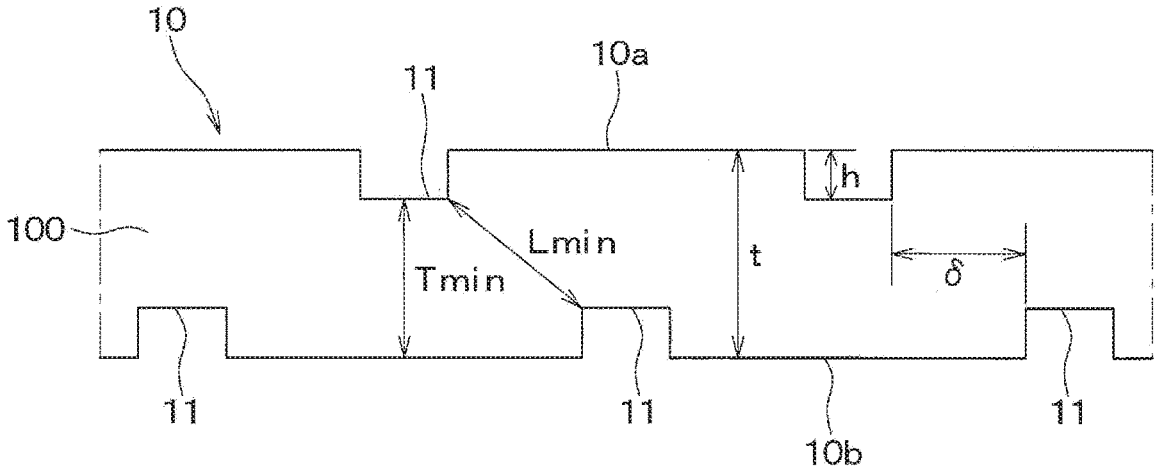
FIG. 30 is an enlarged view of a cross section taken along a line XXX-XXX of FIG. 28.

An enlarged view of a cross section taken along a line XXX-XXX of FIG. 29 is shown in FIG. 30. With reference to FIG. 30, the amount of deviation between the grooves 11 provided in the first surface 10*a* and the grooves 11 provided in the second surface 10*b* will be described. The grooves 11 provided in the first surface 10*a* and the grooves 11 provided in the second surface 10*b* are disposed so as to satisfy the following Expression 1.

$$h(2t-3h)\leq\delta^2 \quad \text{(Ex. 1)}$$

In Expression 1, h is a depth of the groove 11. t is a thickness of the corrugated fin 10, that is, a distance between the first surface 10*a* and the second surface 10*b*. δ is a distance between the grooves 11 in the first surface 10*a* and the grooves 11 in the second surface 10*b* in a plane direction of the corrugated fin 10.

In the following description, a distance between a bottom of the groove 11 of the first surface 10*a* and a bottom of the groove 11 of the second surface 10*b* is referred to as an inter-groove distance Lmin. A distance between the bottom of the groove 11 of the first surface 10*a* and the second surface 10*b* is referred to as a groove plate thickness distance Tmin.

In the fourth embodiment, with satisfaction of the above Expression 1, the inter-groove distance Lmin can be set to be equal to the groove plate thickness distance Tmin, or the inter-groove distance Lmin can be set to be greater than the groove plate thickness distance Tmin. In other words, the amount of deviation between the grooves 11 provided in the first surface 10*a* and the grooves 11 provided in the second surface 10*b* can be set to be greater than the groove plate thickness distance Tmin. As a result, the groove plate thickness distance Tmin becomes the strength rate-limiting, and the strength can be prevented from decreasing due to the approaching of the grooves 11 provided in the first surface 10*a* and the grooves 11 provided in the second surface 10*b*. Therefore, the fourth embodiment can also exhibit the same operation and effects as those of the first to third embodiments.

Fifth Embodiment

A fifth embodiment will be described with reference to FIG. 31. In the fifth embodiment, the configuration of a corrugated fin 10 is changed from that of the fourth embodiment, and the remaining configurations are the same as those of the fourth embodiment, and therefore, only portions different from those of the fourth embodiment will be described.

Figure 31:
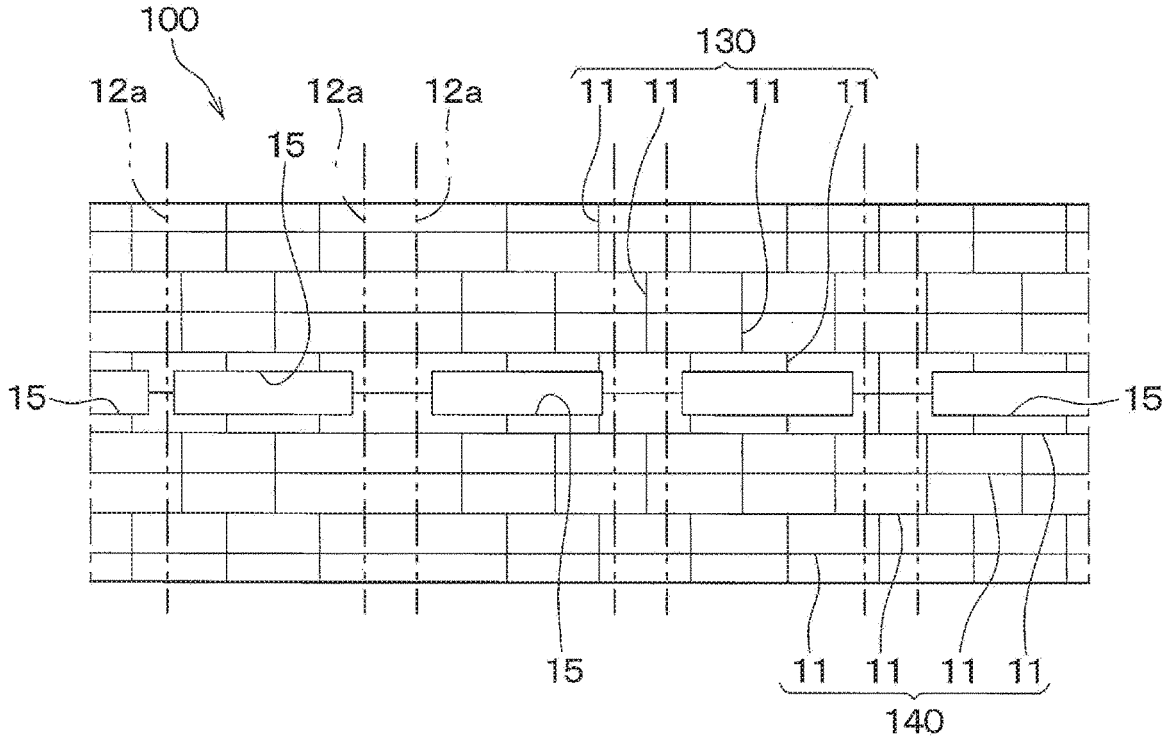
FIG. 31 is a plan view of a plate member configuring a corrugated fin according to a fifth embodiment.

FIG. 31 is a plan view of a plate member 100 configuring the corrugated fin 10 according to the fifth embodiment. Slits 15 are provided in the corrugated fin 10 according to the fifth embodiment. The shape, number, and the like of the slits 15 can be arbitrarily set, and are not limited to those shown in the drawings. The corrugated fin 10 according to the fifth embodiment is also provided with a bending direction groove group 130 and an intersecting direction groove group 140. The multiple grooves 11 configuring the bending direction groove group 130 according to the fifth embodiment are provided so as to intermittently extend along the direction in which the bent portion 12 extends. Therefore, the fifth embodiment can also exhibit the same operation and effects as those of the first to fourth embodiments.

Sixth Embodiment

A sixth embodiment will be described with reference to FIG. 32. In the sixth embodiment, the configuration of grooves 11 is changed from that in the third to fifth embodiments, and the other configurations are the same as those in the third to fifth embodiments, and therefore, only portions different from those in the third to fifth embodiments will be described.

Figure 32:
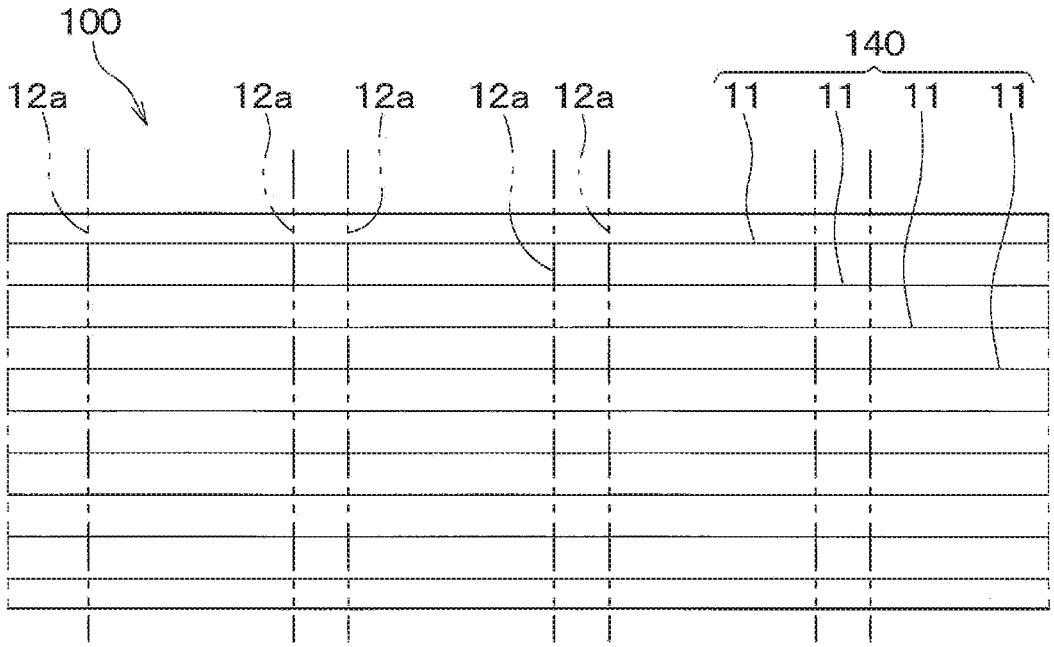
FIG. 32 is a plan view of a plate member configuring a corrugated fin according to a sixth embodiment.

FIG. 32 is a plan view of a plate member 100 configuring a corrugated fin 10 according to the sixth embodiment. A surface of the corrugated fin 10 according to the sixth embodiment is provided with an intersecting direction groove group 140 including the multiple grooves 11 extending in a direction intersecting with a direction in which bent portions 12 extends, and the bending direction groove group 130 described in the third to fifth embodiments is not provided. As a result, the corrugated fin 10 includes a first thick portion T1 in which the grooves 11 are provided and a second thick portion T2 which is thicker than the first thick portion T1 in a cross-sectional view parallel to the direction in which the bent portions 12 extend. For that reason, the rigidity of the corrugated fin 10 according to the sixth embodiment is also high in the direction in which the bent portions 12 extend. Therefore, the sixth embodiment can also exhibit the same operation and effects as those of the first to fifth embodiments. Further, in the sixth embodiment, the configuration of the grooves 11 can be simplified.

Seventh Embodiment

Figure 39:
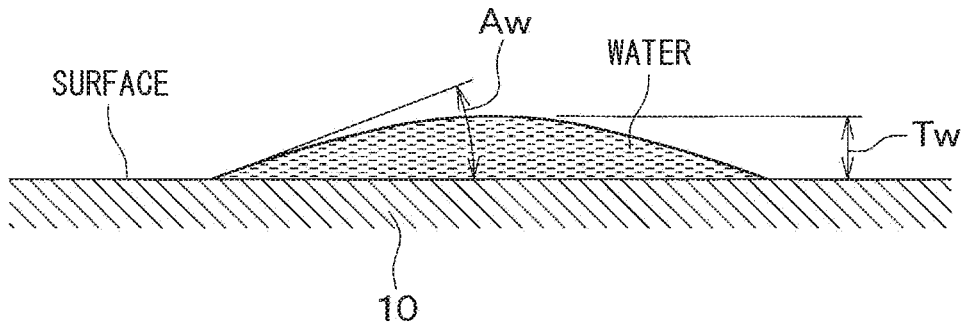
FIG. 39 is a schematic diagram showing a film thickness and a contact angle of water adhered to a surface of a substance such as a corrugated fin according to a seventh embodiment.

In a seventh embodiment, the hydrophilicity of the corrugated fin 10 described in the above embodiments will be described. The hydrophilicity of the surface of the corrugated fin 10 can be improved by providing the multiple grooves 11 in the surface of the corrugated fin 10 as described above. As a result, the wet spreading of the water adhering to the surface of the corrugated fin 10 can be increased. As shown in FIG. 39, a film thickness Tw of the water can be reduced, and a contact angle Aw of the water can be reduced. With the above action, in the heat exchanger 1 according to the present embodiment, the discharge of the condensed water is promoted.

As described above, in the present embodiment, the hydrophilicity is improved by providing the multiple grooves 11 in the surface of the corrugated fin 10. In addition, the shape of the above surface changes little over time. For that reason, the deterioration of the hydrophilicity due to aging hardly progresses, and the hydrophilicity of the surface of the corrugated fin 10 can be stably exhibited.

Figure 40:
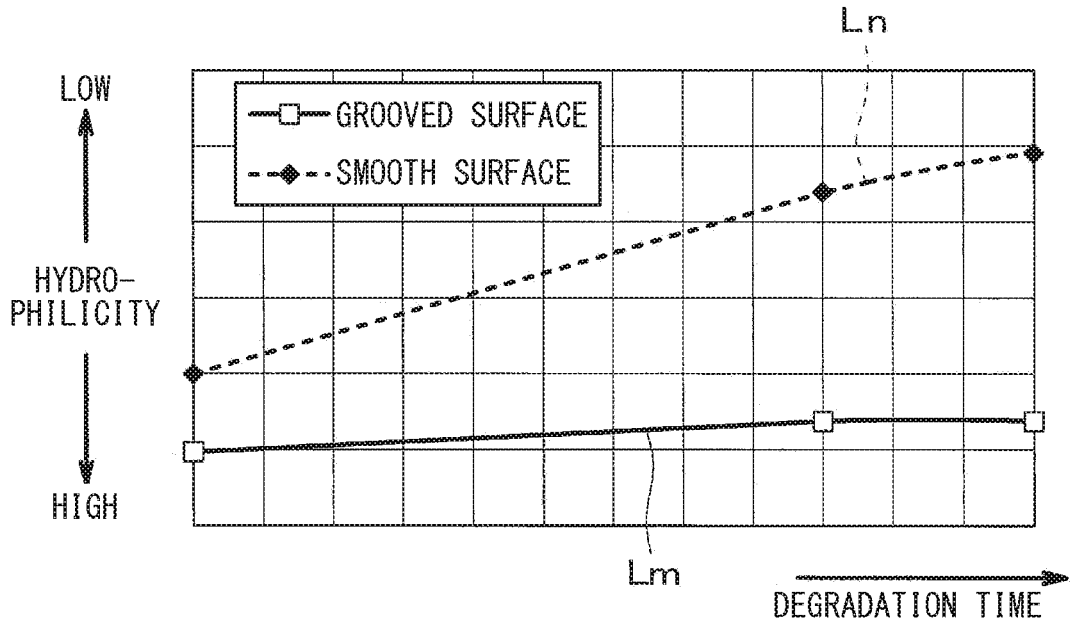
FIG. 40 is a graph showing a result of an experiment in which the deterioration of hydrophilicity over time is compared between a grooved surface and a smooth surface.

For example, FIG. 40 shows a result of an experiment in which it is confirmed that the hydrophilicity of the multiple grooves 11 hardly deteriorates with age. In the experiment shown in FIG. 40, after hydrophilic coating is applied to each of a grooved surface on which the multiple grooves 11 are provided and a smooth surface on which the multiple grooves 11 are not provided, the degree of deterioration of the hydrophilicity of each of the surfaces over time is measured. For example, the higher the hydrophilicity of the surface, the smaller the contact angle Aw of the water adhered to the surface, so that the hydrophilicity of the grooved surface and the smooth surface can be measured by measuring the contact angle Aw of the water attached to each surface. In FIG. 40, a change in hydrophilicity of the grooved surface is indicated by a solid line Lm, and a change in hydrophilicity of the smooth surface is indicated by a dashed line Ln. From the result of the experiment shown in FIG. 40, it is conceivable that the hydrophilicity of the grooved surface is hardly deteriorated with age as compared with the smooth surface.

In the present embodiment, a chemical method such as hydrophilic coating is not performed on the surface of the corrugated fin 10, and the chemical method is not indispensable. However, the effect of improving the hydrophilicity is further increased by combining the provision of multiple grooves 11 and the chemical method.

Eighth Embodiment

In an eighth embodiment, a part of the configuration of the corrugated fin 10 is changed from the first embodiment described above and the like.

Figure 41:
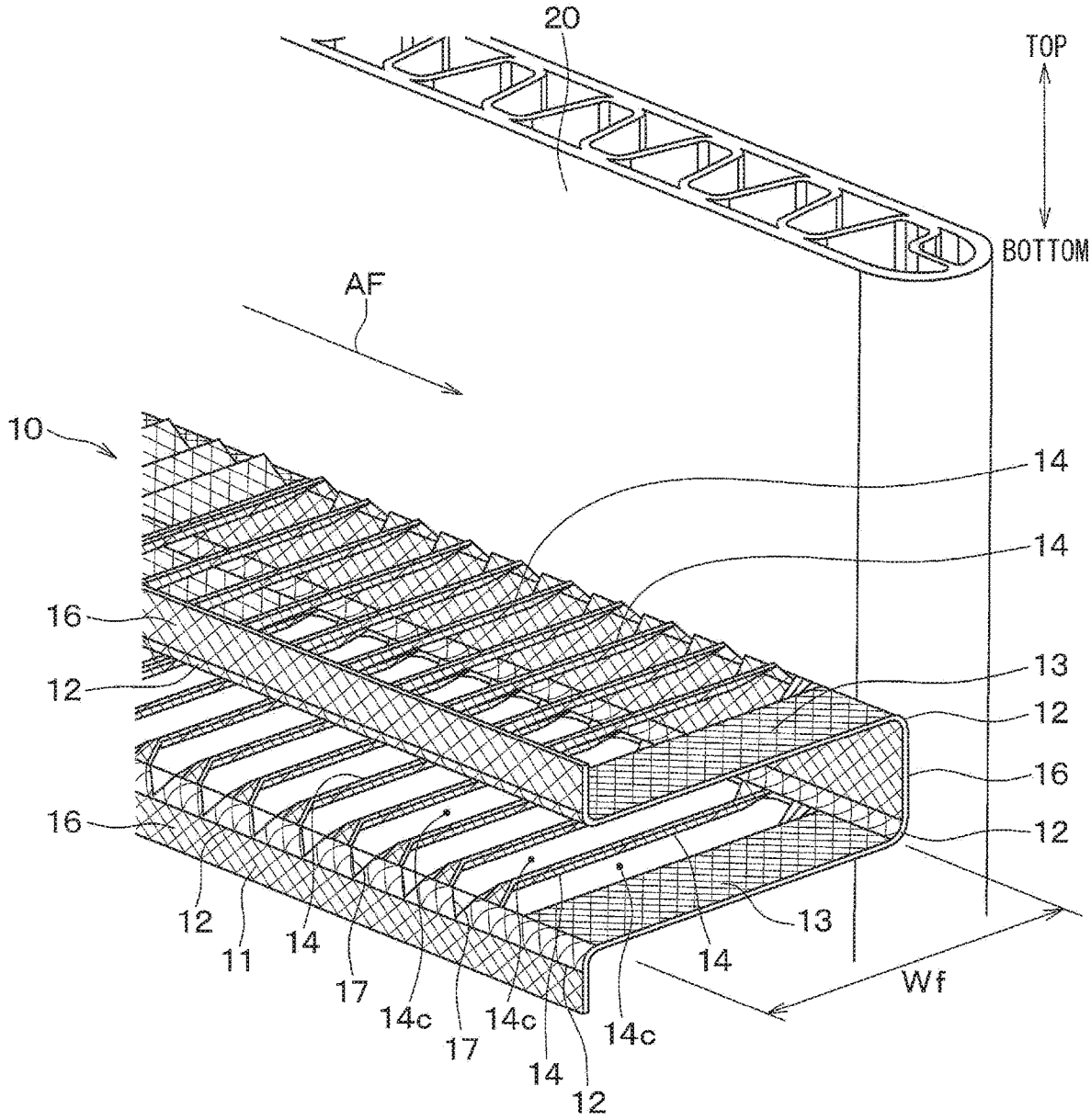
FIG. 41 is a perspective view of a corrugated fin according to an eighth embodiment, which is extracted as a single body, and is partially enlarged.

As shown in FIG. 41, in the present embodiment, as in the first embodiment and the like, louvers 14 as cut protrusions are provided in each fin main body 13 of the corrugated fin 10. The louvers 14 are aligned in an air passing direction AF. louver gaps 14*c* are provided between the multiple louvers 14 aligned in the fin main body 13, as cut gaps formed by cutting and protruding the louvers 14 from the fin main body 13. The louver gaps 14*c* is provided adjacent to the louvers 14.

The corrugated fin 10 has a joint portion 16 joined to the tube 20 between the bent portions 12. The joint portion 16 is joined to the tube 20 by, for example, brazing. The joint portion 16 and the fin main body 13 are connected to each other at a portion having a curved shape including the bent portion 12. In the present embodiment, the portion shaped in a curve including the bent portion 12 is referred to as a curved coupling portion.

The corrugated fin 10 according to the present embodiment is provided with notches 17 each having a shape notched from the louver gap 14*c* as the cut gap into the bent portion 12 (that is, the curved coupling portion). The notch 17 extends to the outside of a width Wf of the louver 14 as the cut protrusion in the direction in which the multiple tubes 20 are aligned.

The notch 17 may be provided in at least one of the right and left bent portions 12 in the direction in which the multiple tubes 20 are aligned, but in the present embodiment, the notches 17 are provided in both of the right and left bent portions 12.

Although the notches 17 may be provided corresponding to some of the multiple louver gaps 14*c* provided in the fin main body 13, in the present embodiment, the notches 17 are provided corresponding to all of the louver gaps 14*c* of the multiple louver gaps 14*c*.

As described above, in the present embodiment, since the notches 17 is provided in the bent portions 12, the portion where the notches 17 are provided can also be used as drain paths, and a drainage of the water in regions around the notches 17 can be smoothly performed.

Figure 42:
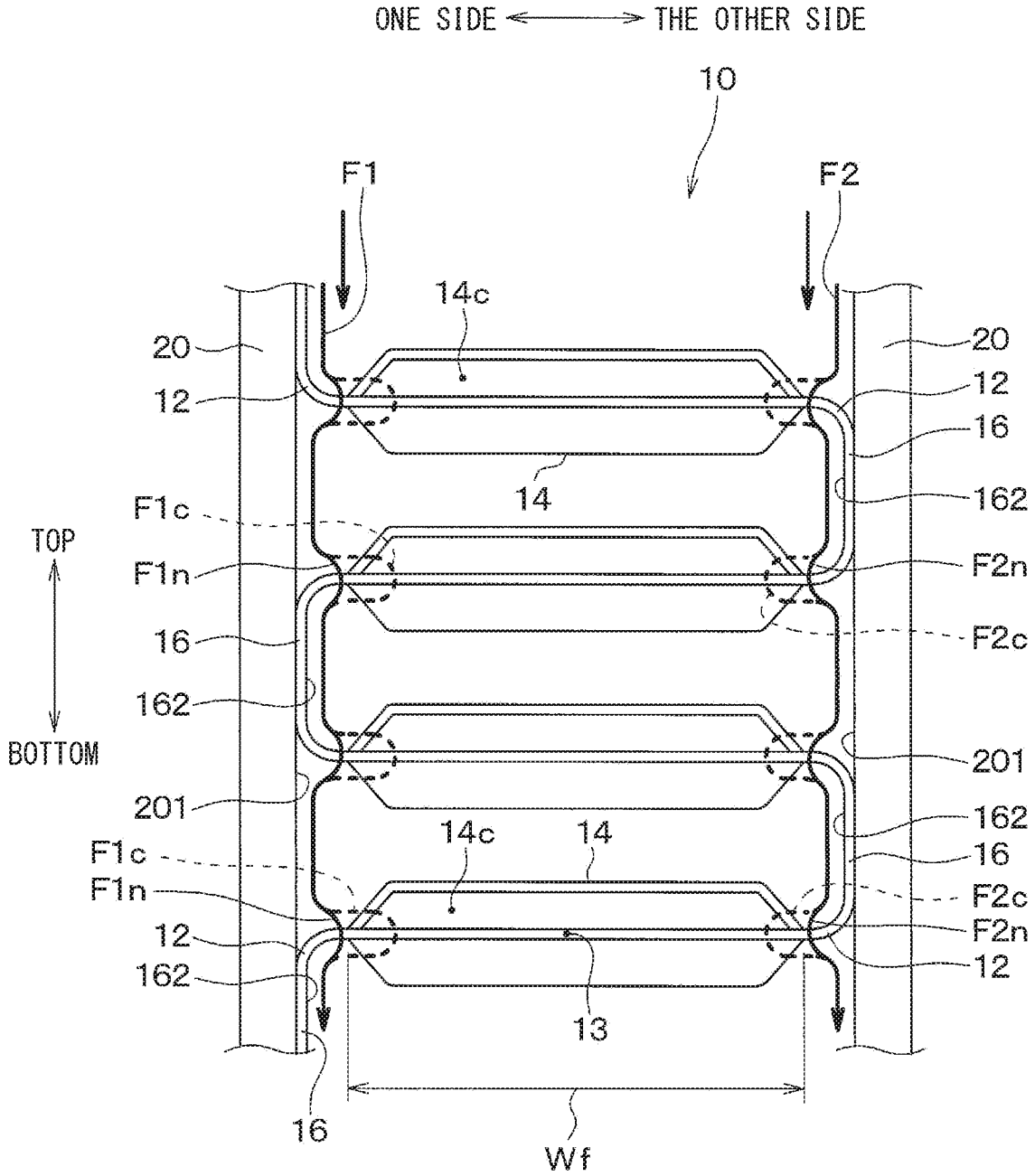
FIG. 42 is a diagram illustrating a drain path of a condensed water flowing along a tube wall surface according to an eighth embodiment.

For example, as shown in FIG. 42, the condensed water flows along trough side surfaces 162 of the joint portions 16 of the corrugated fin 10 and wall surfaces 201 of the tubes 20 from an upper side to a lower side as indicated by arrows F1 and F2, and is drained from a lower portion of the heat exchanger 1 to the outside of the heat exchanger 1. At this time, if there is no notch 17, the drainage path follows a path passing through the louver gaps 14*c* between the louvers 14, as indicated by dashed lines F1*c* and F2*c*.

In contrast, in the present embodiment, the drainage path follows a path passing through the notches 17 closer to the wall surface 201 side of the tubes 20 than the louver gaps 14*c*, as indicated by solid lines F1*n* and F2*n*. Therefore, the condensed water flowing along the drainage path passing through the notches 17 flows down smoothly as compared with the case where the notch 17 is not provided. In this manner, in the present embodiment, since the notches 17 are provided, the condensed water flowing from the upper side can be smooth drained to the outside of the heat exchanger 1.

Ninth Embodiment

In a ninth embodiment, a part of the configuration of the groove 11 of the corrugated fin 10 will be described in detail with respect to the first embodiment and the like described above.

Figure 43:
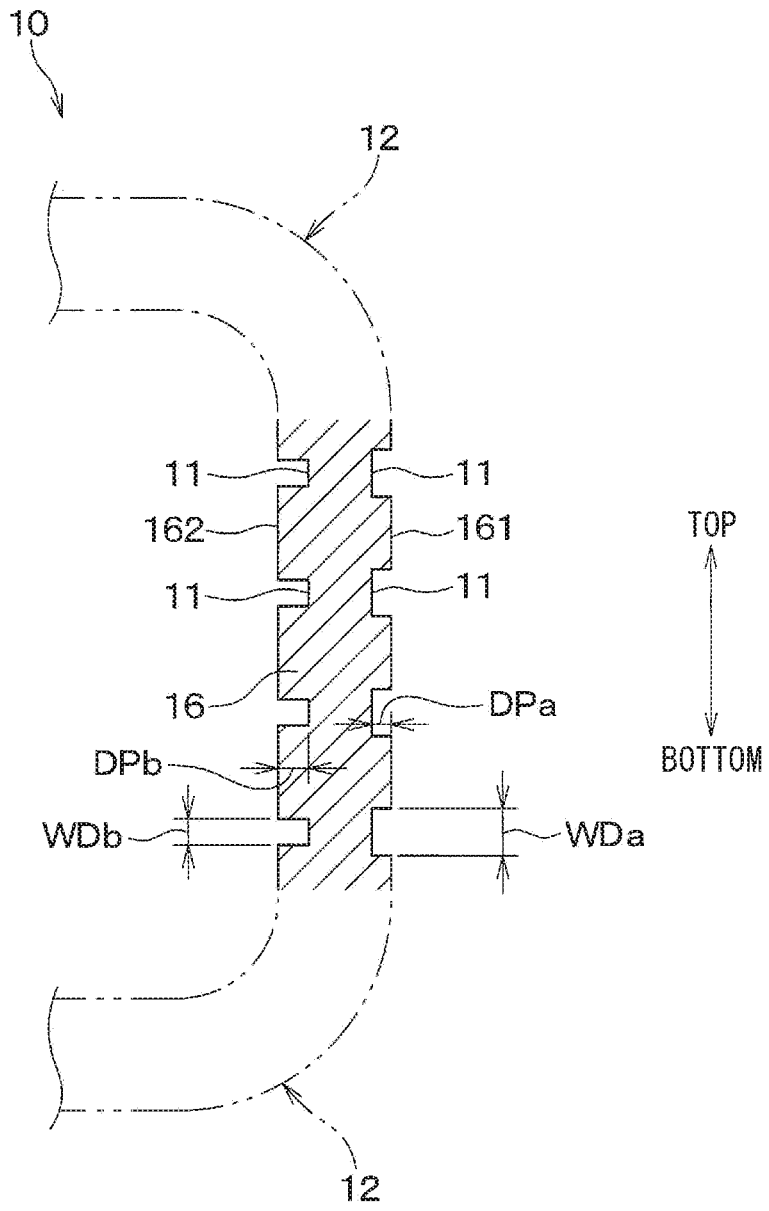
FIG. 43 is a schematic view of a cross section of a joint portion and a peripheral portion of a corrugated fin according to a ninth embodiment.

FIG. 43 schematically shows a cross section of a joint portion 16 and a peripheral portion of the joint 16 in a corrugated fin 10. In the present embodiment, a surface of the joint portion 16 on a tube 20 side in a thickness direction is referred to as a crest side surface (or a first surface) 161, and a surface on the opposite side to the crest side surface 161 in the thickness direction is referred to as a trough side surface (or a second surface) 162.

In the present embodiment, a shape of multiple grooves 11 provided in the crest side surface 161 and a shape of the multiple grooves 11 provided in the trough side surface 162 are different from each other. Specifically, a groove depth DPb of the multiple grooves 11 provided in the trough side surface 162 is deeper than a groove depth DPa of the multiple grooves 11 provided in the crest side surface 161. A groove width WDa of the multiple grooves 11 provided in the crest side surface 161 is larger than a groove width WDb of the multiple grooves 11 provided in the trough side surface 162. In other words, a relationship of DPb>DPa is satisfied, and a relationship of WDa>WDb is satisfied.

The corrugated fin 10 may have only the relationship of DPb>DPa or may have only the relationship of WDa>WDb in the joint portion 16. The corrugated fin 10 may have a relationship of DPb>DPa and a relationship of WDa>WDb in only a part of the joint 16, or may have a relationship of all of the joint portions 16.

In the present embodiment, since the groove depth DPb of the multiple grooves 11 provided in the trough side surface 162 is deeper than the groove depth DPa of the multiple grooves 11 provided in the crest side surface 161, the water is easily collected on the surface of the trough side surface 162 serving as a drain path. Further, in the present embodiment, since the groove width WDb of the multiple grooves 11 provided in the trough side surface 162 is narrower than the groove width WDa of the multiple grooves 11 provided in the crest side surface 161, the water is easily collected on the surface of the trough side surface 162 serving as a drain path. As a result, the water is easily drained smoothly from the heat exchanger 1.

Further, in the present embodiment, since the groove width WDa of the multiple grooves 11 provided in the crest side surface 161 is larger than the groove width WDb of the multiple grooves 11 provided in the trough side surface 162, the corrugated fin 10 can be securely joined to the tube 20 by brazing or the like. Further, in the present embodiment, since the groove depth DPa of the multiple grooves 11 provided in the crest side surface 161 is smaller than the groove depth DPb of the multiple grooves 11 provided in the trough side surface 162, the corrugated fin 10 can be securely joined to the tube 20 by brazing or the like.

Tenth to Twelfth Embodiments

In tenth to twelfth embodiments, a modification of the cut protrusion for promoting a heat transfer provided in the corrugated fin 10 will be described as compared with the first embodiment and the like described above. In other words, in the respective embodiments described above, the corrugated fin 10 has the louvers 14 as the cut protrusions for promoting a heat transfer, but the cut protrusions may be portions other than the louvers 14.

Tenth Embodiment

Figure 44:
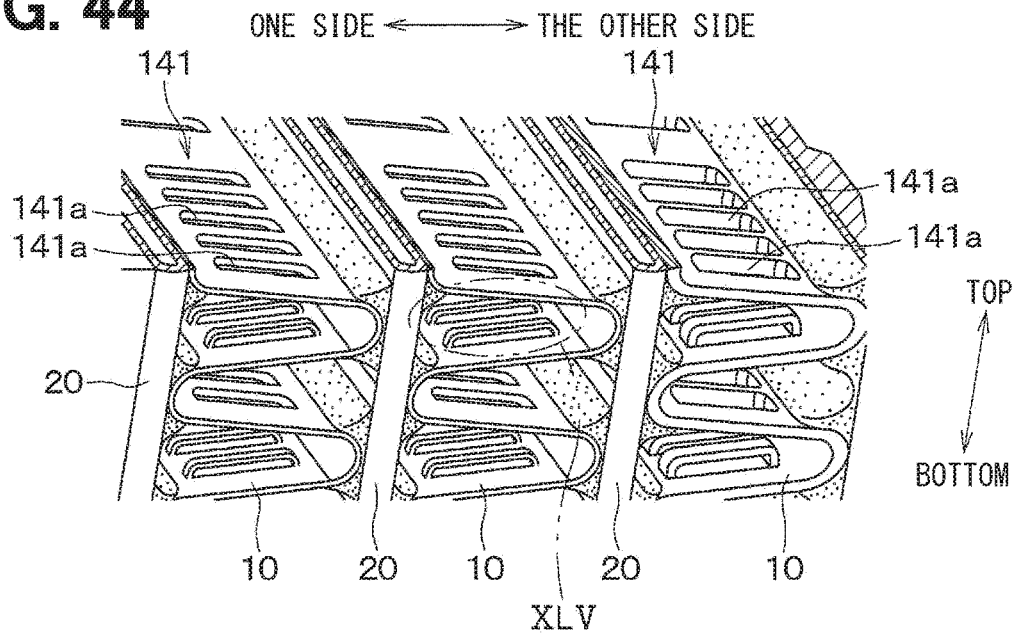
FIG. 44 is a perspective view showing a heat exchanger having slit fins according to a tenth embodiment, in which tubes and corrugated fins of the heat exchanger are partially enlarged.
Figure 45:
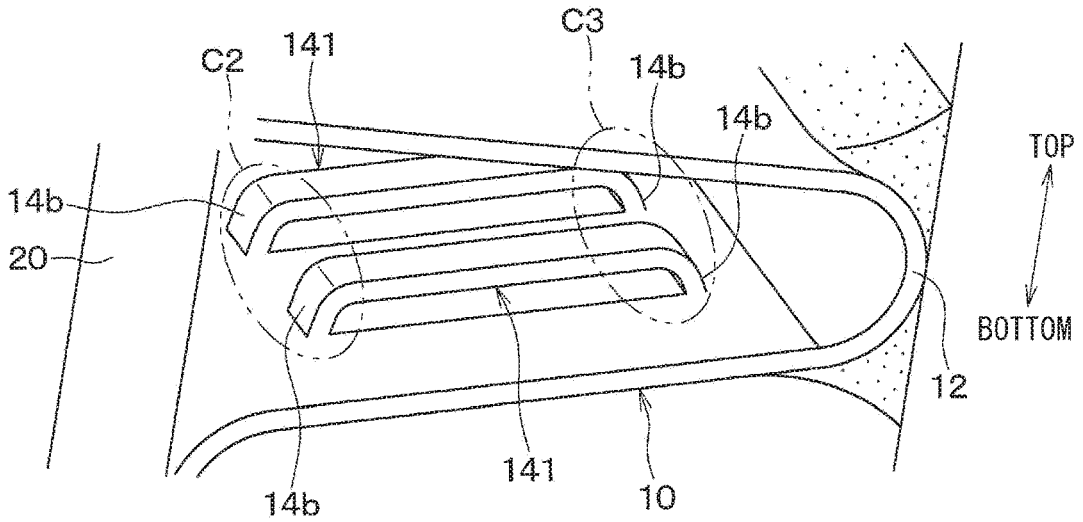
FIG. 45 is an enlarged view of a portion XLV of FIG. 44.

As shown in FIG. 44 and FIG. 45, in a tenth embodiment, a slit fin 141 is illustrated in which cut protrusions form slits 141*a*. In the slit fin 141 according to the present embodiment, for example, multiple grooves 11 are provided in ends 14*b* of the cut protrusions. More specifically, the multiple grooves 11 are provided in ends 14*b* of the cut protrusion indicated by a two-dot chain line C2 and ends 14*b* of the cut protrusion indicated by a two-dot chain line C3 in FIG. 45.

Eleventh Embodiment

Figure 46:
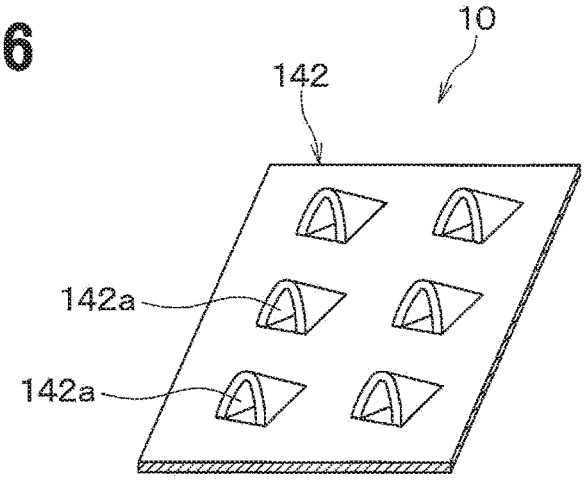
FIG. 46 is a perspective view showing triangular fins according to an eleventh embodiment, which shows cut protrusions of the triangular fins and peripheries of the cut protrusions extracted.

As shown in FIG. 46, in an eleventh embodiment, a triangular fin 142 is shown in which cut protrusions form triangular ventilation openings 142*a*. The multiple grooves 11 are also provided in the triangular fin according to the present embodiment. In FIG. 46, only the ventilation openings 142*a* and peripheries of the ventilation openings 142*a* provided in the corrugated fin 10 are extracted and illustrated, and a corrugated shape of the entire corrugated fin 10 is not illustrated.

Twelfth Embodiment

Figure 47:
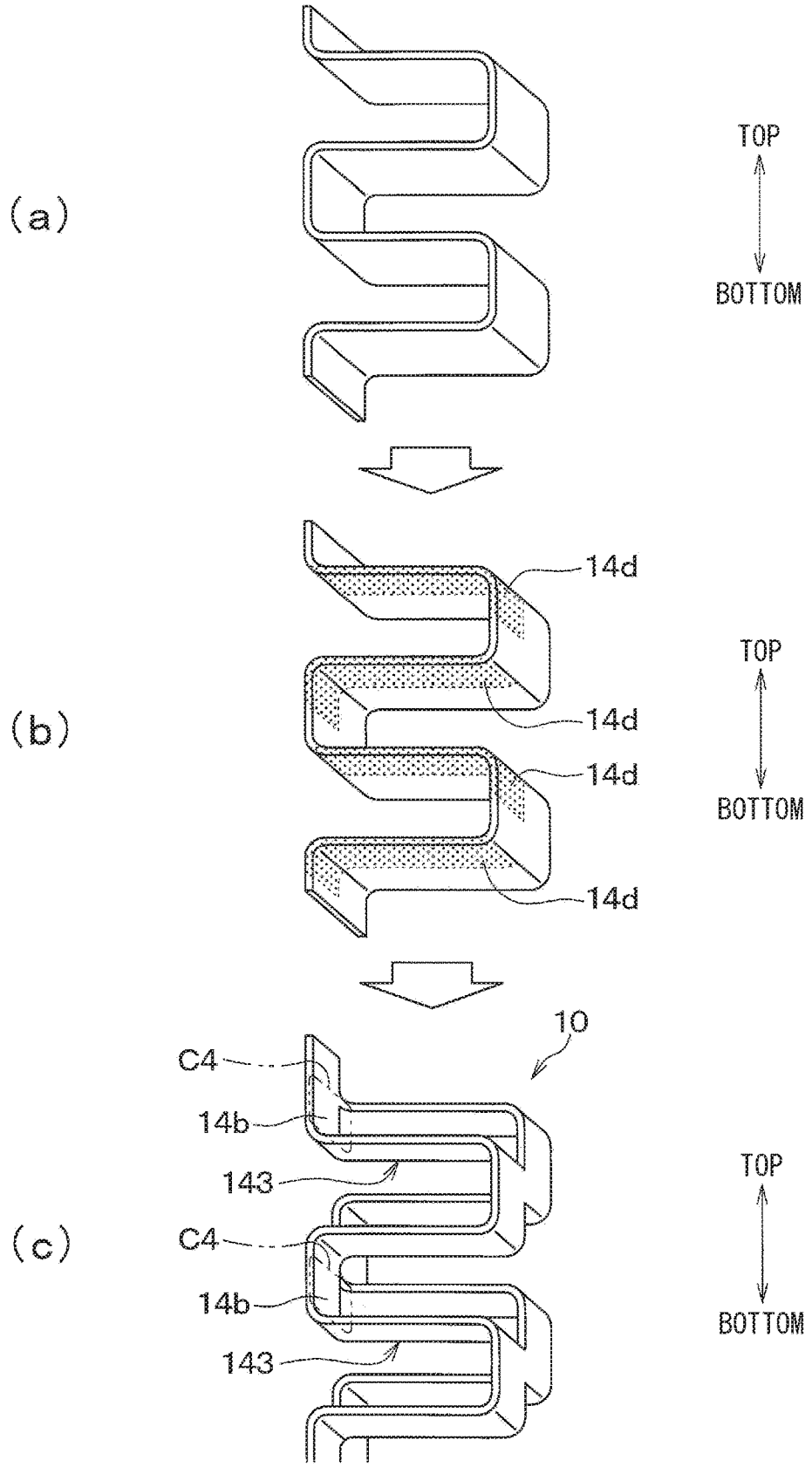
FIG. 47 is a perspective view showing an offset fin according to a twelfth embodiment and simply showing a process of manufacturing the offset fin.

As shown in FIG. 47, in a twelfth embodiment, offset fins 143 are shown in which portions of a corrugated shape are offset to form cut protrusions. Multiple grooves 11 are also provided in the offset fins 143 according to the present embodiment. In the present embodiment, the multiple grooves 11 are provided in ends 14*b* of the cut protrusions indicated by two-dot chain lines C4 in (c) of FIG. 34.

(c) of FIG. 34 shows a finished product of the offset fins 143, and (a), (b), and (c) in FIG. 47 show a manufacturing process of the offset fins 143. In other words, as shown in (a) of FIG. 47, first, a fin material having a corrugated shape is prepared. Next, as shown in (b) of FIG. 47, portions 14*d* of the fin material, which become cut protrusions indicated by point hatching, are cut and protruded so as to be displaced from the other portions. As a result, the offset fins 143 shown in (c) of FIG. 47 are obtained.

As will be described for confirmation, the slit fins 141 shown in FIGS. 44 and 45, the triangular fin 142 shown in FIG. 46, and the offset fin 143 shown in FIG. 47 all have a corrugated shape, and are therefore a kind of the corrugated fins 10. Further, in each of the corrugated fins 10 according to the tenth to twelfth embodiments shown in FIGS. 44 to 47, the multiple grooves 11 may be formed not only on the ends of the cut protrusions but also on the entire corrugated fins 10.

Other Embodiments

The present disclosure is not limited to the embodiments described above, and can be modified as appropriate. The above embodiments are not independent of each other, and can be appropriately combined except when the combination is obviously impossible. Further, in each of the above-mentioned embodiments, it goes without saying that components of the embodiment are not necessarily essential except for a case in which the components are particularly clearly specified as essential components, a case in which the components are clearly considered in principle as essential components, and the like. Further, in each of the embodiments described above, when numerical values such as the number, numerical value, quantity, range, and the like of the constituent elements of the embodiment are referred to, except in the case where the numerical values are expressly indispensable in particular, the case where the numerical values are obviously limited to a specific number in principle, and the like, the present disclosure is not limited to the specific number. Further, in each of the above-mentioned embodiments, when referring to the shape, positional relationship, and the like of a component and the like, the component is not limited to the shape, positional relationship, and the like, except for the case where the component is specifically specified, the case where the component is fundamentally limited to a specific shape, positional relationship, and the like.

(1) In the above respective embodiments, the heat exchanger 1 has been described as being used as an evaporator, but the present disclosure is not limited to the evaporator. The heat exchanger 1 can be used in a variety of applications, for example, a condenser or an intermediate heat exchanger.

(2) In the above respective embodiments, the corrugated fins 10 have been described as outer fins provided on the outside of the tube 20, but the present disclosure is not limited to the above configuration. The corrugated fins 10 can be used, for example, as inner fins.

(3) In the respective embodiments described above, as shown in FIG. 5, the groove depth h of the multiple grooves 12*b* to 15*c* provided on the surface of the corrugated fins 10 is, for example, 10 μm or more, which is preferable. However, it is not essential that the groove depth h is 10 μm or more.

(4) In the respective embodiments described above, the grooves on the surface of the corrugated fins 10 extend linearly, but the present disclosure is not limited to the above configuration, and the grooves may be curved, for example.

The groove widths of the grooves may be uniform or non-uniform. The depths of the grooves may be uniform or non-uniform. Each of the grooves may be intermittently separated.

(5) In the respective embodiments described above, the heat exchanger 1 is disposed so that the tubes 20 are oriented to extend in the vertical direction, but the orientation of installation of the heat exchanger 1 is not limited. For example, the heat exchanger 1 may be arranged such that the tubes 20 are oriented to extend in the horizontal direction. Similarly, in that case, the drainage of water from the louver 14 to the joint portion 16 or the wall surface of the tubes 20 can be promoted. If the draining of the water from the louver 14 is promoted, the deterioration of the performance of the heat exchanger 1 can be reduced, and the increase of the ventilation resistance of the heat exchanger 1 can be inhibited by reducing the thickness of the water film in the louver 14, similarly to the embodiments described above.

(6) In the respective embodiments described above, the heat exchanger 1 has been described as being used as an evaporator, but the present disclosure is not limited to the evaporator. The heat exchanger 1 according to the respective embodiments may be a heat exchanger 1 other than an evaporator as long as water needs to be discharged.

For example, the heat exchanger 1 may be not an evaporator but a heat exchanger 1 provided in an environment to be wettable. As a specific example, an air conditioning condenser and a radiator installed in an engine compartment of a vehicle may get wet during traveling of the vehicle, and thus correspond to the heat exchanger 1 installed in an environment to be wettable.

(7) In the respective embodiments described above, the first fluid flowing through the tubes 20 is a refrigerant, the first fluid is also assumed to be a fluid other than the refrigerant. The second fluid flowing between the tubes 20 is air, but the second fluid is also assumed to be a fluid other than air.

(8) In the embodiments described above, the grooves 11 on the surface of the corrugated fins 10 is provided over the entire surface of the corrugated fins 10, but it is also conceivable that the grooves 11 is provided partially on the surface of the corrugated fins 10. This is because the hydrophilicity and drainability are improved as compared with the case where the groove 11 is absent at all on the surface of the corrugated fins 10.

For example, it is conceivable that the multiple grooves 11 are not formed on both the surfaces of the corrugated fins 10 in the thickness direction, but are formed on only one surface of the corrugated fins 10 in the thickness direction. In other words, in terms of the louver ends, each louver end may have multiple grooves 11 in at least one of the louver ends in the thickness direction. As for the curved coupling portion, the curved connection portion may have the multiple grooves 11 in at least one surface of the curved coupling portion in the thickness direction. Further, in terms of the louver main body portion, the louver main body portion may have the multiple grooves 11 in at least one of the louver main body portion in the thickness direction.

Conclusion

According to a first aspect, shown in a part or all of the embodiments described above, the heat exchanger for exchanging a heat between the fluids includes the tubes, the corrugated fins, and the multiple grooves. A first fluid flows through the tubes. The corrugated fins have the multiple bent portions in which the plate member is bent at the predetermined intervals, and the fin main body disposed between the bent portions, and enhances the heat exchange efficiency between the first fluid flowing inside the tubes and the second fluid flowing outside the tubes. The multiple grooves are provided in the surface of the corrugated fins so as to enhance the hydrophilicity of the surface of the corrugated fins, and the grooves are aligned at the predetermined intervals. The corrugated fins each includes, in a cross-sectional view parallel to the direction in which the bent portions extend, the first thick portion in which the grooves are provided, and the second thick portion having the plate thickness greater than that of the first thick portion.

According to a second aspect, the multiple grooves intermittently extend along the direction in which the bent portions extend.

According to the above configuration, the second thick portion having a plate thickness greater than that of the first thick portion can be disposed in the direction in which the bent portions of the corrugated fins extend.

According to a third aspect, the multiple grooves are provided on one surface of the corrugated fins in the thickness direction and on the other surface of the corrugated fins in the thickness direction.

According to the above configuration, the drainability of both sides of the corrugated fins in the thickness direction can be improved.

According to a fourth aspect, the multiple grooves intermittently extending along the direction in which the bent portions extend are defined as the bending direction groove group. In addition to the bending direction groove group, the surface of the corrugated fins is further provided with the intersecting direction groove group in which the multiple grooves are aligned at the predetermined intervals and extend in a direction intersecting with the bending direction groove group.

According to the above configuration, the bending direction groove group and the intersecting direction groove group are provided so as to connect the bending direction groove group and the intersecting direction groove group from the fin main body over the bent portions. For that reason, the condensed water generated in the fin main body of the corrugated fins easily flows into the bent portions through the bending direction groove group and the intersecting direction groove group. The condensed water that has flowed into the bent portions flows down through the wall of the tubes or the like. Therefore, in the heat exchanger, since the condensed water is prevented from staying in the fin main body of the corrugated fins, the increase in ventilation resistance due to the stagnation of the condensed water can be prevented, and the heat exchanging performance can be enhanced.

According to a fifth aspect, the grooves configuring the bending direction groove group provided one surface of the corrugated fins in the thickness direction and the grooves configuring the bending direction groove group provided on the other surface of the corrugated fins in the thickness direction are provided at positions offset from each other in the thickness direction.

According to the above configuration, in a cross-sectional view parallel to the direction in which the bent portions extend, the thinner portion of the corrugated fins is prevented from continuing. For that reason, the rigidity of the corrugated fins in the direction in which the bent portions extend is increased. Therefore, for example, when a tensile force is applied to a workpiece in the vertical direction of the bent portions at the time of forming the corrugated fins, the workpiece can be prevented from being cracked. The corrugated fins are prevented from buckling at the bent portions and the fin main body, for example, at the time of forming the corrugated fins or at the time of manufacturing the heat exchanger.

According to a sixth aspect, a distance between the bottom of the grooves configuring the bending direction groove group provided on one surface of the corrugated fins in the thickness direction and the bottom of the grooves configuring the bending direction groove group provided on the other surface of the corrugated fins in the thickness direction is referred to as the inter-groove distance. The distance between the bottom of the grooves configuring the bending direction groove group provided on one surface of the corrugated fins in the thickness direction and the other surface of the corrugated fins in the thickness direction is referred to as a groove plate thickness distance. At that time, the inter-groove distance is equal to the groove plate thickness distance, or is greater than the groove plate thickness distance.

According to the above configuration, the amount of deviation between the grooves configuring the bending direction groove group provided on one surface of the corrugated fins in the thickness direction and the grooves configuring the bending direction groove group provided on the other surface can be increased. As a result, the groove plate thickness distance becomes an intensity limiting rate, and the grooves provided on the first surface and the grooves provided on the second surface come close to each other, thereby being capable of preventing the strength from decreasing.

According to a seventh aspect, the multiple grooves configuring the bending direction groove group are arrayed in a grid pattern on the surface of the corrugated fins.

According to the above configuration, the multiple grooves configuring the bending direction groove group intermittently extend along the direction in which the bent portions extend. Therefore, in a cross-sectional view parallel to the direction in which the bent portions of the corrugated fins extend, the first thick portion in which the grooves are provided and the second thick portion thicker than the first thick portion can be disposed.

According to an eighth aspect, the multiple grooves extend obliquely with respect to the direction in which the bent portions extend.

According to the above configuration, when the bent portions are formed by bending a plate member, or when a compression force is applied to the corrugated fins having the bent portions from the vertical direction of the bent portions, or the like, a stress is generated in the corrugated fins substantially uniformly in a direction orthogonal to the direction in which the bent portions extend. This makes it possible to more reliably prevent the corrugated fin from buckling at the bent portion and the fin main body at the time of forming the corrugated fin.

According to a ninth aspect, the heat exchanger for exchanging a heat between the fluids includes the tubes, the corrugated fins, and the multiple grooves. A first fluid flows through the tubes. The corrugated fins have the multiple bent portions in which the plate member is bent at the predetermined intervals, and the fin main body disposed between the bent portions, and enhances the heat exchange efficiency between the first fluid flowing inside the tubes and the second fluid flowing outside the tubes. The multiple grooves are provided on the surface of the corrugated fins so as to enhance the hydrophilicity of the surface of the corrugated fins, and the grooves are aligned at predetermined intervals and extend obliquely with respect to the direction in which the bent portions extend.

According to the above configuration, the ninth aspect can exhibit the same operation and effects as those in the first aspect. Further, in the ninth aspect, when the bent portions are formed by bending a plate member, or when a compression force is applied to the corrugated fins having the bent portion from the vertical direction of the bent portions, or the like, a stress is generated in the corrugated fins substantially uniformly in a direction orthogonal to the direction in which the bent portions extend. For that reason, the rigidity of the corrugated fins in the direction in which the bent portions extend is increased. Therefore, the corrugated fins can be more surely prevented from buckling at the bent portions and the fin main body when the corrugated fins are formed.

According to a tenth aspect, the multiple grooves are provided on one surface of the corrugated fins in the thickness direction and on the other surface of the corrugated fins in the thickness direction.

According to the above configuration, the drainability of both sides of the corrugated fins in the thickness direction can be improved.

According to an eleventh aspect, the multiple grooves are provided symmetrically with respect to a imaginary plane including the center of the bent portions and perpendicular to the direction in which the bent portions extend.

According to the above configuration, for example, when the multiple grooves are formed on a workpiece by a groove forming roller or the like at the time of forming the corrugated fins, a force acting on the workpiece from the groove forming roller becomes uniform on the left and right sides. Therefore, the workpiece can be prevented from twisting with respect to a feeding direction of the groove forming roller.

According to a twelfth aspect, when an angle formed by the direction in which the multiple grooves extend and the imaginary plane is $\theta 1$, $20° \leq \theta 1 \leq 70°$ is met.

According to the above configuration, a stress can be generated in the corrugated fins substantially uniformly in a direction orthogonal to the direction in which the bent portions extend, for example, when the bent portions are formed by bending a plate member, or when a compression force is applied to the corrugated fins having the bent portions from the vertical direction of the bent portions This makes it possible to more reliably prevent the corrugated fin from buckling at the bent portion and the fin main body at the time of forming the corrugated fin.

According to a thirteenth aspect, the multiple grooves are defined as a first groove group. In addition to the first groove group, the surface of the corrugated fins is further provided with a second groove group in which the multiple grooves are aligned at predetermined intervals and extend in a direction intersecting with the first groove group.

According to the above configuration, the first groove group and the second groove group are provided so as to connect the first groove group and the second groove group from the fin main body over the bent portions. For that reason, the condensed water generated in the fin main body of the corrugated fins easily flows through the first groove group and the second groove group to the bent portions. The condensed water that has flowed into the bent portions flows down through the wall of the tubes or the like. Therefore, in the heat exchanger, since the condensed water is prevented from staying in the fin main body of the corrugated fins, the increase in ventilation resistance due to the stagnation of the condensed water can be prevented, and the heat exchanging performance can be enhanced.

According to a fourteenth aspect, the grooves configuring the first groove group provided one surface of the corrugated fins in the thickness direction and the grooves configuring the first groove group provided on the other surface of the corrugated fins in the thickness direction are provided at positions offset from each other in the thickness direction.

According to the above configuration, in a cross-sectional view parallel to the direction in which the bent portions extend, the thinner portion of the corrugated fins is prevented from continuing. For that reason, the rigidity of the corrugated fins in the direction in which the bent portions extend is increased. Therefore, for example, when a tensile force is applied to a workpiece in the vertical direction of the bent portions at the time of forming the corrugated fins, the workpiece can be prevented from being cracked. The corrugated fins are prevented from buckling at the bent portions and the fin main body, for example, at the time of forming the corrugated fins or at the time of manufacturing the heat exchanger.

According to a fifteenth aspect, 15. the grooves configuring the first groove group provided on one surface of the corrugated fins in the thickness direction and the grooves configuring the first groove group provided on the other surface of the corrugated fins in the thickness direction have different angles with respect to the direction in which the bent portions extend when viewed from the same thickness direction.

According to the above configuration, it can be easily realized that the grooves configuring the first groove group provided one surface of the corrugated fins in the thickness direction and the grooves configuring the first groove group provided on the other surface of the corrugated fins in the thickness direction are provided at positions offset from each other in the thickness direction.

According to a sixteenth aspect, the corrugated fins each has a cut protrusion for promoting the heat transfer, in which a part of the fin main body is cut and protruded. The multiple grooves are provided at least on the surface of the cut protrusion.

According to the above configuration, with the provision of the multiple grooves in the louver which exhibits the most heat exchanging performance among the corrugated fins, the drainability of the louver can be improved, and the condensed water can be prevented from staying on the surface of the louver. Therefore, the heat exchanger can prevent an increase in the ventilation resistance in the louvers and enhance the heat exchanging performance.

According to a seventeenth aspect, the fin main body is provided, adjacent to the cut protrusion, with a cut gap formed by making the cut protrusion into cut and protruded shape. The corrugated fins are provided with a notch having a shape notched into a bent portion from a cut gap. The notch extends to the outside of the width of the cut protrusion in the direction in which the multiple tubes are aligned.

According to the above configuration, since the corrugated fins can also use the portion where the notch is provided as a drain path, the region around the notch can be smoothly drained.

According to an eighteenth aspect, the heat exchanger is used as an evaporator for cooling an air as the second fluid passing through the corrugated fins provided on the outside of the tubes by a latent heat of evaporation of the refrigerant as the first fluid flowing inside the tubes.

According to the above configuration, when the heat exchanger is used as an evaporator, a condensed water is generated on the surface of the corrugated fins when the air is cooled. In that case, the heat exchanger can improve the heat exchanging performance of the evaporator by improving the drainability of the condensed water generated on the surface of the corrugated fins.

According to a nineteenth aspect, the heat exchanger cools the air as the second fluid passing through the corrugated fins provided on the outside of the tubes by the first fluid flowing inside the tubes.

According to the above configuration, as the heat exchanger, for example, a cooler core or the like can be exemplified.

According to a twentieth aspect, the heat exchanger is provided in an environment to be wettable.

According to the above configuration, as the heat exchanger, for example, an air conditioning condenser and a radiator installed in an engine compartment of a vehicle can be exemplified.

According to a twenty-first aspect, the multiple grooves have a width of 10 to 50 μm, a depth of 10 μm or more, and a pitch of 50 to 200 μm.

According to the above configuration, the hydrophilicity of the surface of the corrugated fins can be increased by the multiple grooves, and the drainability of the condensed water generated on the surface of the corrugated fins can be improved.

According to a twenty-second aspect, the corrugated fins each have a joint portion joined to the tubes between the bent portions. In this example, a surface of the joint portion on the tube side in the thickness direction is defined as a crest side surface, and a surface on the opposite side to the crest side surface in the thickness direction is defined as a trough side surface. The groove depth of the multiple grooves provided on the trough side surface is deeper than the groove depth of the multiple grooves provided on the crest side surface.

According to the above configuration, the capillary force of the trough side surface serving as the drainage path increases, so that water can be easily collected on the trough side surface. As a result, the water is easily discharged smoothly from the heat exchanger.

According to a twenty-third aspect, the corrugated fins each have a joint portion joined to the tube between the bent portions. In this example, a surface of the joint portion on the tube side in the thickness direction is defined as a crest side surface, and a surface on the opposite side to the crest side surface in the thickness direction is defined as a trough side surface. The groove width of the multiple grooves provided on the crest side surfaces is larger than the groove width of the multiple grooves provided on the trough side surfaces.

According to the above configuration, the groove width of the groove provided on the crest side surface is widened, thereby being capable of securely joining the corrugated fins to the tubes.

According to a twenty-fourth aspect, the corrugated fins formed by bending a plate member at predetermined intervals each include the bent portion, the fin main body, and the multiple grooves. The bent portion is a portion in which the plate member is bent at a predetermined interval. The fin main body is a portion disposed between the bent portions. The multiple grooves are provided in the surface of the corrugated fins so as to enhance the hydrophilicity of the surface of the corrugated fins, and the grooves are aligned at the predetermined intervals. In a cross-sectional view parallel to the direction in which the bent portions extend, the bent portion and the fin main body are configured to include the first thick portion in which the grooves are provided and the second thick portion thicker than the first thick portion.

According to the above configuration, the hydrophilicity of the surface of the corrugated fins is increased by the multiple grooves. For that reason, the drainability of the corrugated fins can be improved, and the condensed water can be prevented from staying on the surface of the corrugated fins.

Further, in the corrugated fin, the second thick portion larger in a plate thickness than the first thick portion is intermittently disposed in a direction in which the bent portions extend, whereby the rigidity in the direction in which the bent portions extend is increased. For that reason, the corrugated fin can be prevented from buckling at the bent portion, for example, when the plate member is bent to form the bent portion at the time of forming the corrugated fin. In addition, the corrugated fin can be prevented from buckling at the fin main body when a compression force is applied to the bent portion in the vertical direction, for example, at the time of forming the corrugated fin or at the time of manufacturing the heat exchanger.

The invention claimed is:

1. A heat exchanger for exchanging a heat between fluids, the heat exchanger comprising:

a tube through which a first fluid flows;

a corrugated fin that includes a plurality of bent portions, a plurality of fin main bodies, and a plurality of cut protrusions, the plurality of bent portions formed by bending a plate member at specified intervals, each of the plurality of fin main bodies disposed between two of the plurality of bent portions, each of the plurality of cut protrusions promoting a heat transfer and being formed by cutting a part of each of the plurality of fin main bodies to be raised, the corrugated fin configured to enhance a heat exchange efficiency between the first fluid flowing through the tube and a second fluid flowing outside the tube; and a plurality of grooves that are disposed on a surface of the corrugated fin to enhance a hydrophilicity of the surface of the corrugated fin, the plurality of grooves arranged to be spaced away from each other at specified intervals and extending to be angled relative to an extending direction of each of the plurality of bent portions, wherein the plurality of grooves are formed on at least the plurality of bent portions and the plurality of cut protrusions, and each of the plurality of grooves is a channel that is recessed from the surface of the corrugated fin.

2. The heat exchanger according to claim 1, wherein the plurality of grooves are disposed on one surface and the other surface of the corrugated fin in a thickness direction.

3. The heat exchanger according to claim 1, wherein the plurality of grooves are disposed to be symmetrical with respect to an imaginary plane on which the plurality of bent portions have centers in, and which is perpendicular to, the extending direction of the plurality of bent portions.

4. The heat exchanger according to claim 1, wherein an angle formed between an imaginary plane on which the plurality of bent portions have centers in, and which is perpendicular to, the extending direction of the plurality of bent portions and an extending direction of each of the plurality of grooves is defined as $\theta 1$, wherein $20° \leq \theta 1 \leq 70°$.

5. The heat exchanger according to claim 1, wherein the plurality of grooves are grouped as a first groove group, a second groove group defined by the plurality of grooves is further disposed on the surface of the corrugated fin, and the plurality of grooves of the second groove group are arranged to be spaced away from each other at specified intervals and extend along a direction intersecting with the plurality of grooves of the first groove group.

6. The heat exchanger according to claim 5, wherein the plurality of grooves of the first groove group disposed on one surface of the corrugated fin in the thickness direction and the plurality of grooves of the first groove group disposed on the other surface of the corrugated fin in the thickness direction are offset from each other in the thickness direction.

7. The heat exchanger according to claim 5, wherein each of the plurality of grooves of the first groove group disposed on one surface of the corrugated fin in the thickness direction has, when viewed in the thickness direction, a first angle relative to the extending direction of each of the plurality of bent portions, each of the plurality of grooves of the first groove group disposed on the other surface of the corrugated fin in the thickness direction has, when viewed in the thickness direction, second angles relative to the extending direction of each of the plurality of bent portions, and the first angle is different from the second angle.

* * * * *